US007740242B2

(12) United States Patent
Kusama et al.

(10) Patent No.: US 7,740,242 B2
(45) Date of Patent: Jun. 22, 2010

(54) DOCUMENT FEEDER

(75) Inventors: Takuro Kusama, Nagoya (JP); Toshitaka Iwago, Nagoya (JP); Yoichi Horaguchi, Tajimi (JP); Ryoichi Matsushima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 481 days.

(21) Appl. No.: 11/677,731

(22) Filed: Feb. 22, 2007

(65) Prior Publication Data

US 2007/0194520 A1 Aug. 23, 2007

(30) Foreign Application Priority Data

Feb. 22, 2006 (JP) ..... 2006-044803

(51) Int. Cl.
*B65H 39/10* (2006.01)

(52) U.S. Cl. ..... 271/301; 271/303; 399/374

(58) Field of Classification Search ..... 271/301
See application file for complete search history.

(56) References Cited

U.S. PATENT DOCUMENTS

| | | | | |
|---|---|---|---|---|
| 5,826,155 | A * | 10/1998 | Kobayashi et al. | 399/367 |
| 5,947,464 | A * | 9/1999 | Takada | 271/3.03 |
| 5,991,592 | A | 11/1999 | Kobayashi et al. | |
| 6,115,578 | A * | 9/2000 | Mandel et al. | 399/367 |
| 6,151,478 | A | 11/2000 | Katsuta et al. | |
| 6,161,831 | A * | 12/2000 | Kusakabe et al. | 271/186 |
| 6,209,861 | B1 * | 4/2001 | Kakuta et al. | 271/3.02 |
| 6,215,976 | B1 * | 4/2001 | Shida et al. | 399/367 |
| 6,438,350 | B1 | 8/2002 | Hasegawa et al. | |
| 6,522,860 | B2 * | 2/2003 | Nose et al. | 399/374 |
| 2004/0057079 | A1 * | 3/2004 | Ohsawa | 358/2.1 |

FOREIGN PATENT DOCUMENTS

| | | |
|---|---|---|
| JP | 58-191147 U | 12/1983 |
| JP | 6227701 | 8/1994 |
| JP | 10087108 | 4/1998 |
| JP | 11157756 | 6/1999 |
| JP | 2001-302016 A | 10/2001 |
| JP | 2000344384 | 12/2002 |

OTHER PUBLICATIONS

JP Office Action dtd Sep. 30, 2008, JP Appln. 2006-044803, partial English Translation.

* cited by examiner

*Primary Examiner*—Patrick Mackey
*Assistant Examiner*—Howard Sanders
(74) *Attorney, Agent, or Firm*—Banner & Witcoff, Ltd.

(57) ABSTRACT

A document feeder includes a conveying path extended from a document supplying position to a reading position, a first conveying roller pair provided upstream from the reading position and nipping and conveying the document, a second conveying roller pair provided downstream from the reading position and nipping and conveying the document faster than the first conveying roller pair, a post-reading conveying path extended downstream from a nipping position of the second conveying roller pair, the post-reading conveying path being located above a plane tangent to the second conveying roller pair at the nipping position running in a reverse sheet feed direction, and a third conveying roller pair provided on the post-reading conveying path and nipping and conveying the document conveyed from the second conveying roller pair at a conveying force equivalent to that of the second conveying roller pair.

13 Claims, 16 Drawing Sheets

DOCUMENT FEEDER

CROSS-REFERENCE TO RELATED APPLICATION

This application claims priority from Japanese Patent Application No. 2006-044803, filed on Feb. 22, 2006, the entire subject matter of which is incorporated herein by reference.

TECHNICAL FIELD

Aspects of the present invention relate to a document feeder having a conveying path, a first conveying roller pair and a second conveying roller pair. The conveying path is extended from a document supplying position in a predetermined direction, curved downward for reversing a sheet feed direction and reaching a reading position, then guiding a document from the reading position to a reverse sheet feed direction which is opposite to the sheet feed direction. The first conveying roller pair is provided further upstream in the sheet feed direction than the reading position of the conveying path and above the reading position, and nips and conveys a document passing through the conveying path. The second conveying roller pair is provided further downstream in the sheet feed direction than the reading position of the conveying path and above the reading position, and nips and conveys a document passing through the conveying path at a document conveying speed faster than the first conveying roller pair.

BACKGROUND

There has been proposed an image reading device mounted on a copying device, a scanning device or a multi-function device having copy functions and scan functions. The image reading device has an automatic document feeder (ADF) which nips and conveys a document to a discharge tray through the conveying path from the sheet teed tray. Further, there has been proposed an automatic document feeder which carries out conveying for reading the document at a midpoint of conveyance by reversing leading and trailing ends of a document by switching the document back at the midpoint of conveyance in order to read image sprinted on both first and second sides of the document (refer to JP-A-10-87108, for example).

FIG. 15 shows a conveying route of a related image reading device having an ADF capable of reading both sides of a document. As shown in FIG. 15, a document P, which is placed on a sheet feed tray 100 with the first side (page 1) facing upward, is conveyed to a conveying path 102 by a sheet feed roller 101. In the conveying path 102, the document P is conveyed to the conveying rollers 103 mounted appropriately, and the first side of the document P is read by an image reading unit such as a reduced-optical charge coupled device (CCD) or a contact image sensor (CIS) while passing through a reading position X. When the trailing end of the document P after the first side has been read is detected by a sensor, a sheet discharge roller 104 is halted when the document is nipped in the vicinity of the trailing end of the document P.

As shown in FIG. 16, the sheet discharge roller 104 is reversed, and the document P is conveyed to a switchback path 105. The document P advances again from the switchback path 105 to a position upstream of the reading position X on the conveying path 102. Accordingly, the leading end of the document P and the trailing end are reversed with each other. Then, the document P is conveyed by the conveying rollers 103, and the second side of the document P is read by the image reading unit while passing through the reading position X. When the trailing end of the document P after the second side has been read is detected by a sensor, the sheet discharge roller 104 is again halted when the document is nipped in the vicinity of the trailing end. Thereafter, the document P is conveyed reversely through the switchback path 105. The document P which advances again from the switchback path 105 into the conveying path 102 is in a state that the trailing end and the leading end of the document are again reversed with each other, that is, the first side is faced to the reading position X. Then, the document P is conveyed through the conveying path 102 and discharged to the sheet discharge tray 106, with the first side facing downward. Thereby, the first side and the second side of the document P are read and the document P is discharged to the sheet discharge tray 106 sequentially in the order placed on the sheet feed tray 100.

In the conveying process of document P by the ADF, the document P passing through the reading position X is conveyed respectively being nipped by the conveying rollers 103 mounted at the respective positions upstream and downstream from the reading position X. In general, the downstream conveying roller 103 is set to be greater in peripheral speed (speed on the roller face) than the upstream conveying roller 103. Thereby, the document P is conveyed in a way of being pulled by the downstream conveying roller 103 at the reading position X and therefore no curling is developed in the documents P.

When the trailing end of a document P in a sheet feed direction passes through the upstream conveying roller 103 at the reading position X, tension applied to the document P by the respective conveying rollers 103 upstream and downstream at the reading position is released. Thus, it is considered that behavior of the document P become unstable. In general, a difference in the peripheral speed between the respective conveying rollers 103 upstream and downstream from the reading position is set within a range which will not cause the above-described unstable behavior of the document P. However, when a sheet discharge roller 104 is arranged further downstream from the downstream conveying roller 103, the peripheral speed of the sheet discharge roller 104 may affect the behavior of the document P. Further, when a conveying path 102 is configured differently or a switchback path is provided separately, the behavior of the document P may be changed by the configuration of the conveying path downstream from the reading position. Therefore, a combination of factors influencing the behavior of the document P results in unstable behavior of the document P at the reading position. There is a fear that image reading of the document P may be affected by an image reading unit. However, factors influencing behavior of the document P substantially remain unknown. Thus, it is difficult to feed the document P at the reading position taking every factor into account.

SUMMARY

Aspects of the present invention provide a document feeder capable of conveying documents stably at a reading position.

DETAILED DESCRIPTION

General Overview

Figure 1:
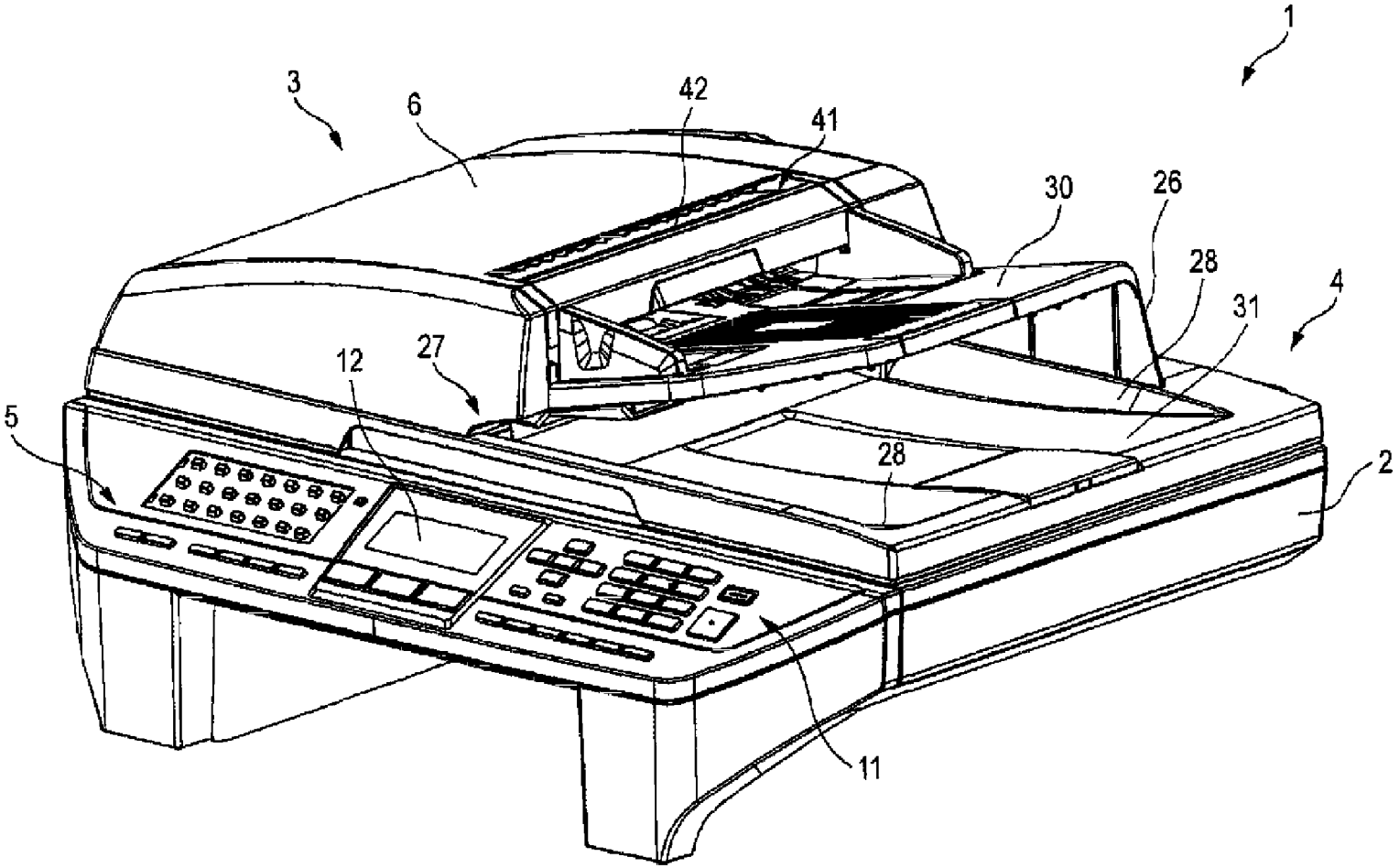
FIG. 1 is a perspective view showing an image reading device according to an aspect of the present invention.

According to an aspect of the invention, a document feeder comprises: a conveying path which is extended from a document supplying position in a predetermined direction, curved downward so as to reverse a sheet feed direction and reaching a reading position, the conveying path guiding a document from the reading position to a reverse sheet feed direction which is opposed to the sheet feed direction; a first conveying roller pair which is provided upstream in the sheet feed direction from the reading position of the conveying path and is provided above the reading position, the first conveying roller pair nipping and conveying the document passing through the conveying path; a second conveying roller pair which is provided downstream in the sheet feed direction from the reading position of the conveying path and is provided above the reading position, the second conveying roller pair nipping and conveying the document passing through the conveying path at a document conveying speed faster than the first conveying roller pair; a post-reading conveying path which is provided in the conveying path and is extended downstream from a nipping position of the second conveying roller pair, the post-reading conveying path being located above a plane tangent to the second conveying roller pair at the nipping position running in the reverse sheet feed direction; and a third conveying roller pair which is provided on the post-reading conveying path, the third conveying roller pair nipping and conveying the document conveyed from the second conveying roller pair at a conveying force equivalent to that of the second conveying roller pair.

According to another aspect of the invention, a document feeder comprises: a conveying path which is extended from a document supplying position in a predetermined direction, curved downward so as to reverse a sheet feed direction and reaching a reading position, the conveying path guiding a document from the reading position to a reverse sheet feed direction which is opposed to the sheet feed direction; a first conveying roller pair which is provided upstream in the sheet feed direction from the reading position of the conveying path and is provided above the reading position, the first conveying roller pair nipping and conveying the document passing through the conveying path; a second conveying roller pair which is provided downstream in the sheet feed direction from the reading position of the conveying path and is provided above the reading position, the second conveying roller pair nipping and conveying the document passing through the conveying path at a document conveying speed faster than the first conveying roller pair; a post-reading conveying path which is provided in the conveying path and is extended downstream from a nipping position of the second conveying roller pair in a direction having a slope relative to a horizontal plane, the slope being as large as a slope of a line which is tangent to the second conveying roller pair at the nipping position running in the reverse sheet feed direction relative to the horizontal plane; and a third conveying roller pair which is provided on the post-reading conveying path, the third conveying roller pair nipping and conveying the document conveyed from the second conveying roller pair at a conveying force equivalent to that of the second conveying roller pair.

<Illustrative Aspects>

Hereinafter, aspects of the present invention will be described with reference to the drawings as appropriate. As a matter of course, the aspects are not limited as such, and may be changed as appropriate.

Figure 2:
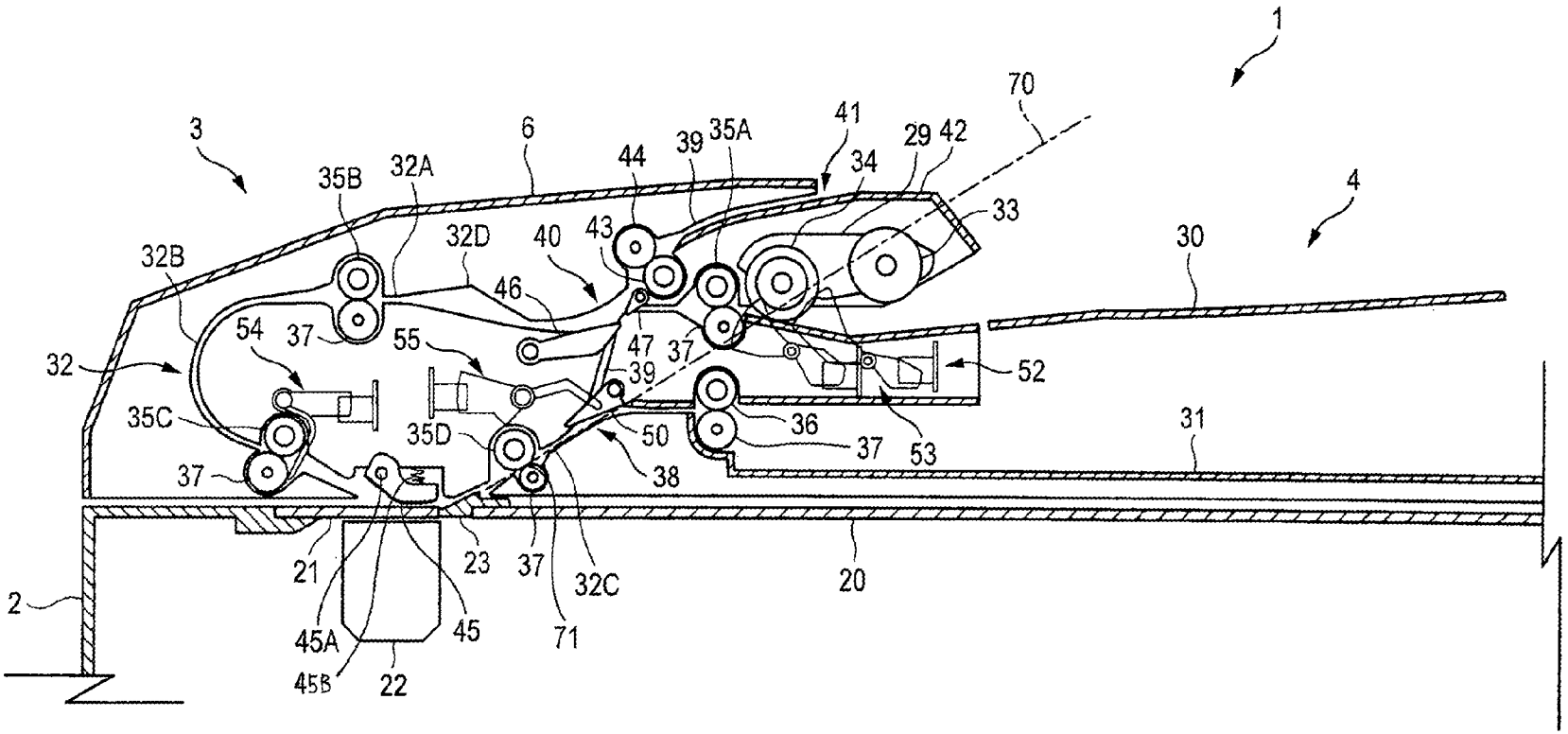
FIG. 2 is a longitudinal sectional view of the image reading device.
Figure 3:
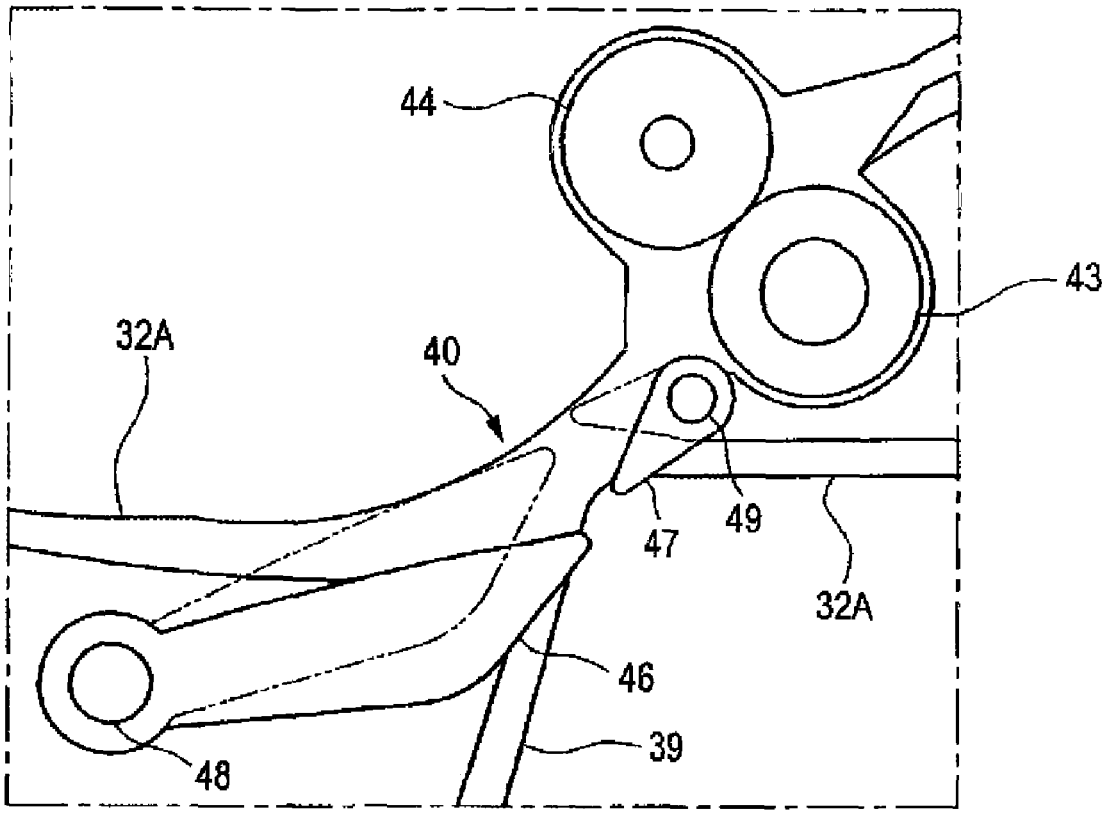
FIG. 3 is an enlarged view showing an intersecting position.
Figure 4:
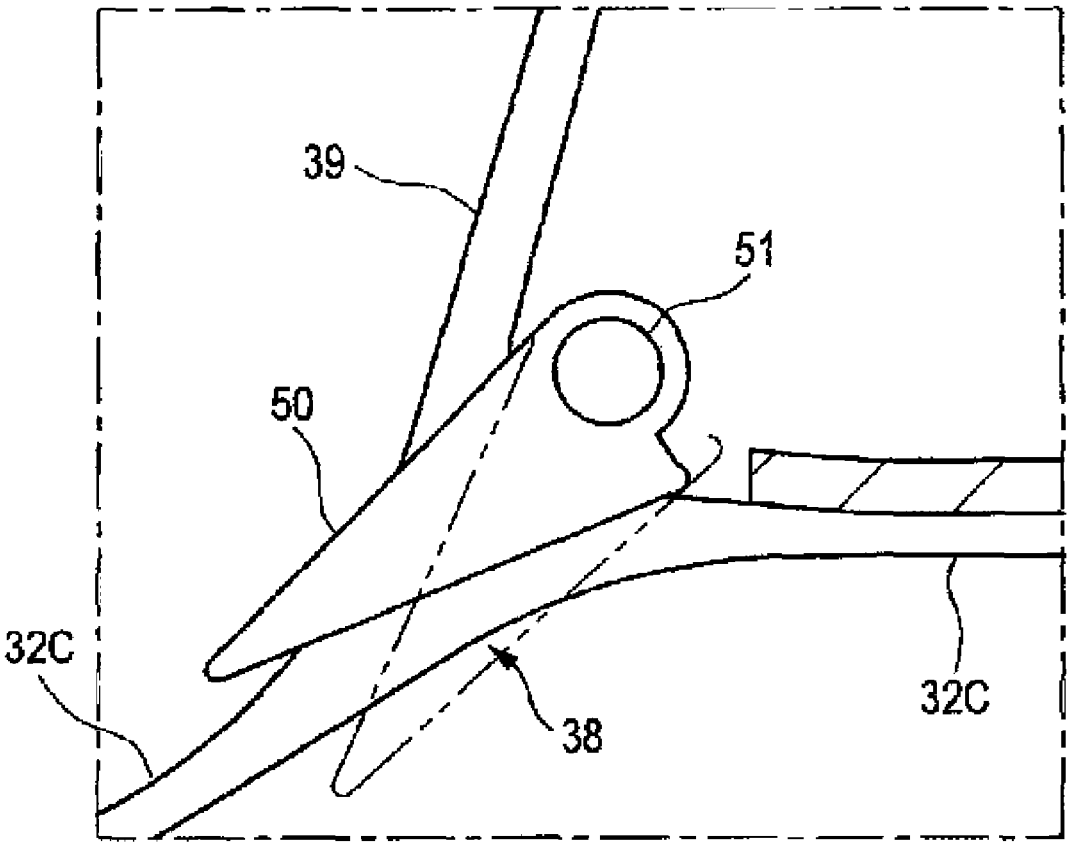
FIG. 4 is an enlarged view showing a connecting position.
Figure 5:
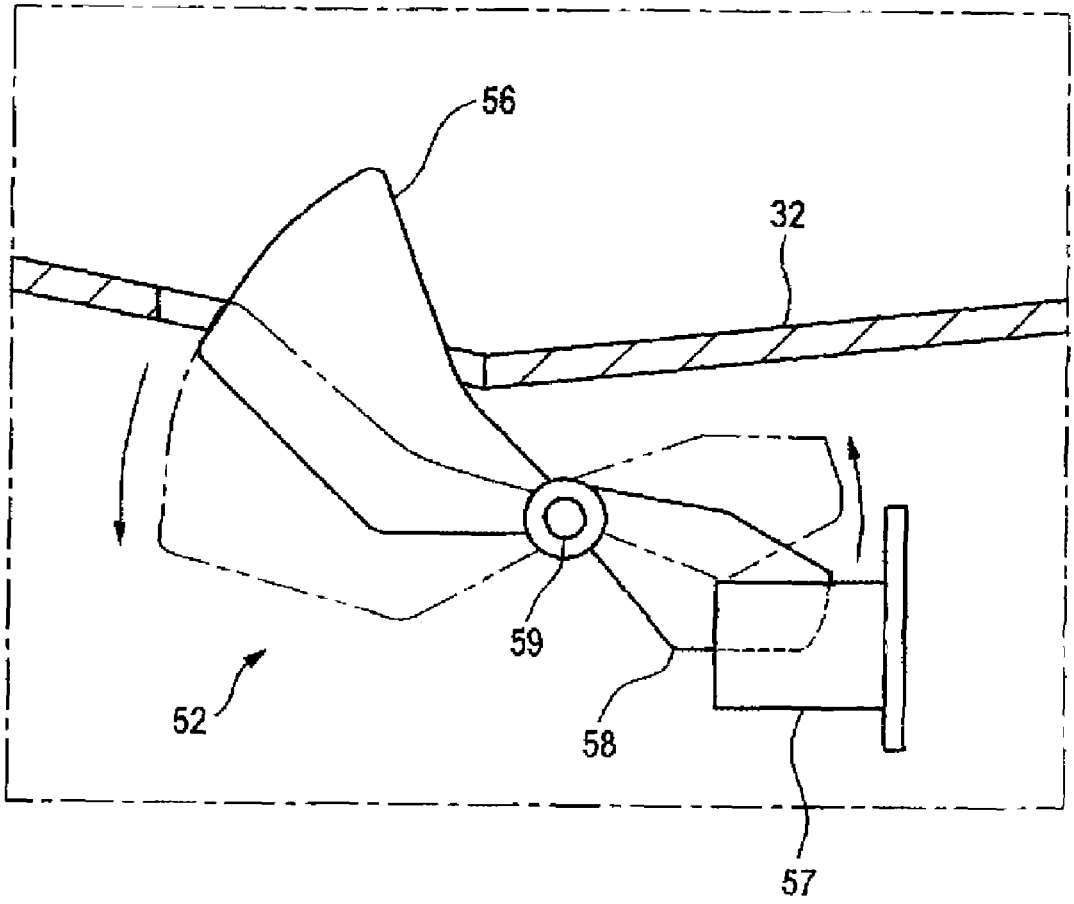
FIG. 5 is an enlarged view showing a first front sensor.

FIG. 1 is a view showing an image reading device 1 according to an aspect of the present invention. FIG. 2 is a longitudinal sectional view showing an inner configuration of the image reading device 1. FIG. 3 is an enlarged view showing a configuration of a conveying path 32 in the vicinity of an intersecting position 40. FIG. 4 is an enlarged view showing a configuration of the conveying path 32 in the vicinity of a connecting position 38. FIG. 5 is an enlarged view showing a configuration of a first front sensor 52.

The image reading device 1 functions as an image reading device for reading images on a document, for example, in a copying device, facsimile device, a scanning device and a multi function device (MFD) which includes integral functions to copy, fax and scan.

As shown in FIG. 1 and FIG. 2, the image reading device 1 is a device in which a document cover 4 is mounted on a document placing base 2 acting as a flat bed scanner (FBS) so as to be opened or closed freely via hinges on the back face (at the rear part of a sheet). The document cover 4 has an ADF 3 which is a mechanism for automatically conveying documents. The ADF 3 functions as a document feeder.

An operation panel 5 is provided on the front face of the document placing base 2. The operation panel 5 has various operation keys 11 and a liquid crystal portion 12. A user inputs desired instructions by using the operation pane 15. The image reading device 1 will make predetermined actions in response to a predetermined input. The image reading device 1 is connected to a computer and can be operated not only by instructions input to the operation panel 5 but also by instructions sent from the computer via a printer driver, a scanner driver, etc.

As shown in FIG. 2, the document placing base 2 has platen glasses 20 and 21 on the top face which is opposed to the document cover 4. When the document cover 4 is opened, the platen glasses 20 and 21 are exposed as the upper face of the document placing base 2. When the document cover 4 is closed, a whole part of the upper face of the document placing base 2 including the platen glasses 20 and 21 is covered. An image reading unit 22 is mounted inside the document placing base 2 so as to be opposed to the platen glasses 20 and 21.

The platen glass 20 is made of a transparent glass plate, for example. Documents are placed on the platen glass 20 when an image reading device 1 is used as an FBS. An opening for exposing the platen glass 20 is formed at the center of an upper face of the document placing base 2. An area of the platen glass 20 exposed from the opening is an area for reading documents at the FBS.

The platen glass 21 is made of a transparent glass plate, for example. The platen glass 21 is a reading position when the ADF 3 of the image reading device 1 is used. An opening for exposing the platen glass 21 is formed at the reading position of the document placing base 2. The platen glass 21 exposed from the opening is extended in a far direction of the image reading device 1, corresponding to the length of an image reading unit 22 in a main scanning direction.

A positioning member 23 is provided between the platen glass 20 and the platen glass 21. As with the platen glass 21, the positioning member 23 is a long flat-plate like member extended in the far direction of the image reading device 1. When a document is placed on the platen glass 20, which is a document-placing face on the FBS, the positioning member 23 is used as a positioning reference of the document. Therefore, marks indicating a central position and both end positions according to sizes of various documents such as A4 and B5 are provided on the upper face of the positioning member 23. A guide face is formed on the upper face of the positioning member 23. The guide face bends and scoops up the document which passes on the platen glass 21 by the ADF 3 in order to return the document to the ADF 3.

The image reading unit 22 is a so-called line image sensor which emits light to a document through the platen glasses 20 and 21 from a light source, focuses the light reflected from the document on a light-receiving element by using a lens and converts the light into an electric signal. The image reading unit 22 reads images on a document which is conveyed on the platen glass 21 by the ADF 3 by using the width direction of the conveying path 32 on the ADF 3 as a scanning line. The image reading unit 22 includes, for example, a CIS and a CCD. The image reading unit 22 is provided below the platen glasses 20 and 21 so as to move in a reciprocating manner by a belt driving mechanism which is a scanning mechanism. The image reading unit 22 moves in a reciprocating manner in parallel with the platen glasses 20 and 21 by a driving force of a cartridge motor.

The document cover 4 has the ADF 3. The ADF 3 continuously conveys documents from a sheet feed tray 30 functioning as a document placing portion through a conveying path 32 to a sheet discharge tray 31 functioning as a document discharging portion. In the course of conveying documents by the ADF 3, they are conveyed to a reading position on the platen glass 21 and images of the documents are read by an image reading unit 22 on standby below the platen glass 21. One end of the conveying path 32 connected to the sheet feed tray 30 functions as a document supplying position.

As shown in FIG. 1 and FIG. 2, the document cover 4 has a sheet feed tray 30 and a sheet discharge tray 31. The sheet feed tray 30 and the sheet discharge tray 31 are configured in a two-stage form (upper and lower), in which the sheet feed tray 30 is given as the upper side. Documents subjected to image reading by the ADF 3 are placed on the sheet feed tray 30. A plurality of documents are placed on the sheet feed tray 30 such that these documents are stacked with the first side facing upward. The leading end of the documents in a sheet feed direction is inserted into the conveying path 32. The back face of the sheet feed tray 30 on the image reading device 1 is curved downward and forms a protective wall 26. The lower end of the protective wall 26 is connected to the upper face of the document cover 4. The protective wall 26 prevents documents on the sheet discharge tray 31 from falling down when the document cover 4 is opened with respect to a document placing base 2. A notched portion 27 is formed on a part of the cabinet of the ADF 3 below the sheet feed tray 30 on the front face of the image reading device 1. The visibility of documents discharged to the sheet discharge tray 31 from the front face of the image reading device 1 is increased by the notched portion 27. Incidentally, small-sized documents are usually lower in visibility from the sheet feed tray 30. However, the notched portion 27 expands the space between the sheet feed tray 30 and the sheet discharge tray 31. Accordingly, the visibility of small-sized documents can be increased.

The sheet discharge tray 31 is located at a site apart in a vertical direction below the sheet feed tray 30 and formed integrally with the upper face of the document cover 4. Documents which have been read for images are discharged from the conveying path 32 to the sheet discharge tray 31. Such documents that have been read for images are retained by the sheet discharge tray 31 separated from documents on the sheet feed tray 30. Discharged documents are stacked in the sheet discharge tray 31 with the first side facing downward. Both end portions 28 which are the front face and the back face of the image reading device 1 on the sheet discharge tray 31 are inclined faces. The inclined faces are warped upward toward the both ends. The both end portions 28 are able to pull out documents by sliding them along the inclined faces of the both end portions 28 in a way of pressing them down, when documents discharged to the sheet discharge tray 31 are taken out. Accordingly, these documents can be easily taken out from the sheet discharge tray 31.

As shown in FIG. 2, a conveying path 32 is formed inside the ADF 3. The conveying path 32 is extended from the sheet feed tray 30 in a horizontal direction to one end of the document cover 4 (the left side in FIG. 2), curved downward so as to reverse the sheet feed direction (the left direction in FIG. 2), reaching a reading position on the platen glass 21, guiding documents from the reading position to the reverse sheet feed direction (the right direction in FIG. 2) which is opposite the above sheet feed direction and connected to the sheet discharge tray 31. In other words, the conveying path 32 is in a substantially transverse U shape when viewed longitudinally. The conveying path 32 is continuously formed from members which constitute an ADF main body, guide plates and guide ribs as a channel having a predetermined width through which documents can pass. As described above, the sheet feed tray 30 and the sheet discharge tray 31 are provided in a two-stage form (upper and lower). The conveying path 32 is formed in a substantially transverse U shape when viewed longitudinally so as to connect the two stages. Accordingly, the width of the ADF 3 (the lateral direction in FIG. 2) can be made narrower and the size of the image reading device 1 can be reduced.

The conveying path 32 is roughly divided into three portions: an upper portion 32A and a lower portion 32C, which configure a linear portion of the two-stage form (upper and lower) in a substantially U shape, and a curved portion 32B curved so as to connect continuously the upper portion 32A with the lower portion 32C. Further, a space 32D for permitting the deflection of a document Gn is formed at the upper portion 32A on the conveying path 32. The conveying path 32 is commonly used as a conveying route (conveying path) of documents for reading images on one face and both sides of documents by the ADF 3.

A Document conveying unit, which conveys documents from the sheet feed tray 30 to the sheet discharge tray 31, is disposed on the conveying path 32. In detail, the document conveying unit is configured by a pickup roller 33, a separation roller 34, conveying rollers 35A, 35B, 35C and 35D, a sheet discharge roller 36 and a pinch roller 37 respectively mounted on the conveying path 32. Further, these individual rollers functioning as the document conveying unit are driven by a motor 67 (refer to FIG. 6) functioning as a driving source.

As shown in FIG. 2, the pickup roller 33 and the separation roller 34 are provided in the vicinity of the uppermost stream on the conveying path 32, in which a direction orthogonal to a sheet feed direction is given as a rotating axis. The pickup roller 33 is provided at the edge portion of an arm 29 so as to rotate freely. The arm 29 is supported on the base end to the shaft of the separation roller 34 so that the edge portion can be moved vertically. The separation roller 34 is arranged in a position apart from the pickup roller 33 to a sheet feed direction. The separation roller 34 is rotated so as to be in contact with a face which is opposed to the conveying path 32. The pickup roller 33 and the separation roller 34 are driven and rotated by a driving force of a motor 67. The arm 29 is also moved vertically by a driving force of the motor 67. The pickup roller 33 and the separation roller 34 are identical in diameter and rotated at the same peripheral speed. A separation pad is disposed at a position which is opposed to the separation roller 34. The separation pad is in contact with the roller face of the separation roller 34 to separate documents by a friction force.

The conveying rollers 35A, 35B, 35C and 35D are disposed at individually different positions on the conveying path 32. In the present aspect, the conveying roller 35A is disposed immediately downstream from the separation roller 34 in a sheet feed direction. The conveying roller 35B is disposed at an upper portion 32A on the conveying path 32. The conveying roller 35C is disposed at a lower portion 32C on the conveying path 32 or immediately upstream from the reading position in the sheet feed direction. The conveying roller 35D is disposed at the lower portion 32C on the conveying path 32 or immediately downstream from the reading position in the sheet feed direction. Since the reading position on the platen glass 21 is at the lowest portion on the conveying path 32, the conveying rollers 35A, 35B, 35C and 35D are all arranged upstream from the reading position.

Pinch rollers 37 are provided so as to be available at the respective positions which are opposed to the conveying rollers 35A, 35B, 35C and 35D. Each of the pinch rollers 37 is elastically urged at the shaft and press contacts with the roller face of each of the conveying rollers 35 in a pair. When each of the conveying rollers 35A, 35B, 35C and 35D is rotated, the pinch rollers 37 are also rotated accordingly. When a document has advanced between the individual conveying rollers 35A, 35B, 35C and 35D and these pinch rollers 37 which configure the respective pairs with them, each of the pinch rollers 37 is retreated against an elastic urging force. The documents are nipped between the pinch rollers 37 in a way such that they are press contacted with each of the conveying rollers 35. The rotating force of the individual conveying rollers 35A, 35B, 35C and 35D is conveyed to the documents, and the documents are conveyed to the direction of rotation of the individual conveying rollers 35A, 35B, 35C and 35D.

Of the individual conveying rollers 35A, 35B, 35C and 35D and the pinch rollers 37, which configures the respective pairs with the conveying rollers, the conveying roller 35C and the pinch rollers 37 disposed upstream from a reading position in a sheet feed direction function as a first conveying roller pair. The conveying roller 35D and the pinch rollers 37 arranged downstream from the reading position in the sheet feed direction function as a second conveying roller pair. Further, an arrangement of other conveying rollers 35A and 35B is made as an example, and each of the conveying rollers on the conveying path 32 may be changed in number and arrangement.

A sheet discharge roller 36 is arranged in the vicinity of the most downstream on the conveying path 32. As with the conveying rollers 35A, 35B, 35C and 35D, the sheet discharge roller 36 is driven and rotated by a driving force of a motor 67. A pinch roller 37 is also provided at a position which is opposed to the sheet discharge roller 36. The pinch roller 37 is elastically urged by springs and press contacts with the sheet discharge roller 36.

A reading guide 45 is provided at a position at which the conveying path 32 is opposed to a platen glass 21, that is, at a position opposed to a reading position. As with the platen glass 21, the reading guide 45 is a member long in the far direction of the image reading device 1. A face on which the reading guide 45 is opposed to the platen glass 21 is a guide face of a document. The guide face is warped upward toward the upstream in the sheet feed direction. Accordingly, the document which is conveyed through a curved portion 32B on the conveying path 32 can be smoothly guided on the platen glass 21.

The reading guide 45 is supported so as to move rotationally by a shaft 45A provided on an ADF main body. The shaft 45A is extended to a direction orthogonal to the sheet feed direction (a direction perpendicular to the space in FIG. 2). The reading guide 45 supported by the shaft 45A is moved rotationally so that the downstream portion in the sheet feed direction can be retreated upward. The reading guide 45 is elastically urged by springs, such as spring 45B, toward a platen glass 21. Therefore, the reading guide 45 is constantly kept in contact with the platen glass 21 unless any external force is applied thereto. A projection projecting downward is formed on both ends of the reading guide 45 in a longitudinal direction. The projection is brought into contact with the platen glass 21 and forms a predetermined clearance between the platen glass 21 and the guide face of the reading guide 45. Documents conveyed through the conveying path 32 pass through the clearance between the platen glass 21 and the guide face of the reading guide 45.

A switchback path 39 functioning as the post-reading conveying path is connected to a connecting position 38 at a lower portion 32C of the conveying path 32. The switchback path 39 returns a document, the first side of which has been read for images at a reading position from downstream at the reading position, to upstream on the conveying path 32, with the leading end and the trailing end reversed with each other when images on both sides are read. The switchback path 39 is extended from the connecting position 38 obliquely upward toward the sheet feed tray 30, intersecting with an upper portion 32A on the conveying path 32 and reaching a place above the sheet feed tray 30. As shown in FIG. 2, the switchback path 39 and the conveying path 32 form a conveying path from the conveying roller 35C to a switchback roller 44 (described later) into a substantially in a shape of an S when viewed longitudinally. Documents conveyed from an intersecting position 40 of the upper portion 32A with the switchback path 39 in a switchback manner are returned to the conveying path 32.

The switchback path 39 is extended above from a tangent line 70 running from a nipping position 71 of the conveying roller 35D and the pinch roller 37 in a reverse sheet feed direction (the right side in FIG. 2). In other words, the switchback path 39 is located above a plane tangent to the conveying roller 35D and the pinch roller 37 at the nipping position 71 in the reverse sheet feed direction. Further, in other words, the switchback path 39 is extended in a direction having a slope relative to a horizontal plane, the slope being as large as a slope of a line which is tangent to the conveying roller 35D and the pinch roller 37 at the nipping position 71 in the reverse sheet feed direction relative to the horizontal plane. As shown in FIG. 2, the tangent line 70 passes through the nipping position 71 of the conveying roller 35D and the pinch roller 37. A straight line connecting the nipping position 71 with the rotating axis of the conveying roller 35D is orthogonal to the tangent line 70. A conveying path from the reading position to the connecting position 38 is formed obliquely above substantially along the tangent line 70 at the lower portion 32C on the conveying path 32. The switchback path 39 extended from the connecting position 38 is extended above from the tangent line 70 and intersected with the upper portion 32A. In contrast, a conveying path reaching from the connecting position 38 to the sheet discharge tray 31 is extended substantially in a horizontal direction below the tangent line 70.

A dead end 41 on the switchback path 39 is opened with respect to an outer face of the ADF 3 (outside the image reading device 1). A document supporting portion 42 extended from the dead end 41 to a horizontal direction is formed on the sheet feed tray 30 from the dead end 41 on the switchback path 39. The document supporting portion 42 supports a document moved out from the dead end 41 on the switchback path 39. The document supporting portion 42 configures an upper cover 6 of the ADF 3 above a sheet feed roller 33 and a separation roller 34. The upper cover 6 is formed in a way to cover the whole part of the ADF 3 including the sheet feed roller 33 and the separation roller 34. Accordingly, the upper cover 6 forms a cabinet of the ADF 3 (cabinet of the image reading device 1). The document supporting portion 42 configured as the upper cover 6 is extended from the dead end 41 toward the sheet feed tray 30 up to the upstream from a conveying position of the sheet feed roller 33 and the separation roller 34. Thereby, a part of the document, which has advanced into the switchback path 39 and protruded outside the ADF 3 from the dead end 41 when images are read on both sides, is supported at the document supporting portion 42 and prevented from hanging downstream (the left side in FIG. 2) from the conveying position of documents placed on the sheet feed tray 30.

A switchback roller 43 is disposed on the dead end 41 from the intersecting position 40 of the switchback path 39. If a driving force is transmitted from a motor 67 to the switchback roller 43, the switchback roller 43 rotates both forward and backward with a direction orthogonal to a sheet feed direction given as a rotating axis. A pinch roller 44 is provided at a position opposed to the switchback roller 43. The pinch roller 44 is elastically urged at the shaft by springs and press contacts with the face of the switchback roller 43. Thus, the pinch roller rotates according to the rotation of the switchback roller 43. A force by which the pinch roller 44 is elastically urged against the switchback roller 43 is set to be weaker than that by which the pinch roller 37 is elastically urged against the conveying roller 35D. Therefore, documents are nipped between the switchback roller 43 and the pinch roller 44 at a nipping pressure weaker than that of the conveying roller 35D or the pinch roller 37. The documents are nipped by the pinch roller 44 so as to press contact with the switchback roller 43, and a rotating force of the switchback roller 43 is transmitted to the documents. Accordingly, the documents are conveyed to a rotational direction of the switchback roller 43. A force of conveying the documents by the switchback roller 43 and the pinch roller 44 is adjusted by a nipping pressure and a peripheral speed to be described later and set equivalent to a force of conveying the documents by the conveying roller 35D and the pinch rollers 37. The switchback roller 43 and the pinch roller 44 function as a third conveying roller pair.

As shown in FIG. 2 and FIG. 3, a guide flap 46 and a guide flap 47 for guiding documents to a desired conveying route are disposed at the intersecting position 40. The guide flap 46 is disposed so as to move rotationally in a predetermined range around a shaft 48 provided at a corner (the left lower side in FIG. 3) between a reading position on the conveying path 32 at an intersecting position 40 and a connecting position 38 on the switchback path 39. The guide flap 46 is a substantially blade-shaped flat plate, and the leading end thereof is projected toward the intersecting position 40. Only one guide flap 46 is indicated in FIG. 2 and FIG. 3. However, in reality, a plurality of the same-shaped guide flaps 46 are provided at predetermined intervals in the width direction of the conveying path 32 (a direction perpendicular to the space in FIG. 3) and the plurality of guide flaps 46 are moved rotationally in an integrated manner.

The guide flap 46 is moved rotationally around the shaft 48. The guide flap 46 is changed in posture, that is, into a third guiding posture shown by the solid line and a fourth guiding posture shown by the double chained line in FIG. 3. The guide flap 46 is brought into contact with a guide member of the conveying path 32 or that of the switchback path 39, for example. Thereby, the guide flap 46 is prevented from being moved rotationally below in FIG. 3 from the third guiding posture and above in FIG. 3 from the fourth guiding posture. When the guide flap 46 is changed into the third guiding posture, a conveying route from the sheet feed tray 30 (the right side in FIG. 3) to the reading position (the left side in FIG. 3) on the conveying path 32 is continuously connected and also a conveying route from the conveying path 32 to the connecting position 38 (the lower side in FIG. 3) on the switchback path 39 is closed. Thereby, a document arriving from the sheet feed tray 30 on the conveying path 32 at an intersecting position 40 advances into the reading position on the conveying path 32 and at the same time prevented from advancing into a connecting position 38 on the switchback path 39. Further, a document arriving from the dead end 41 on the switchback path 39 (the upper side in FIG. 3) at the intersecting position 40 advances into the reading position on the conveying path 32 and is prevented from advancing into the connecting position 38 on the switchback path 39.

When the guide flap 46 is changed into the fourth guiding posture, a conveying route from the connecting position 38 to the dead end 41 on the switchback path 39 is continuously connected and also a conveying route from the connecting position 38 on the switchback path 39 to the reading position on the conveying path 32 is closed. Thereby, a document arriving from the connecting position 38 on the switchback path 39 at the intersecting position 40 advances into the dead end 41 on the switchback path 39 and is prevented from advancing into the reading position on the conveying path 32.

The conveying route is changed by the guide flap 46 when a document is brought into contact with the guide flap 46. The guide flap 46 is constantly in a third guiding posture as shown by the solid line in FIG. 3 due to its own weight or under a force urged by an elastic member such as springs. When the document conveyed from a connecting position 38 on the switchback path 39 to an intersecting position 40 is brought into contact with the guide flap 46, the guide flap 46 is moved rotationally so as to be pushed upward in FIG. 3, and changed into a fourth guiding posture as shown by the double chained line in FIG. 3. In contrast, the document conveyed from the dead end 41 on the switchback path 39 to the intersecting position 40 is brought into contact with the guide flap 46, but the guide flap 46 is prevented from being moved rotationally toward below in FIG. 3 from the third guiding posture. Therefore, the document is guided by the guide flap 46 and advanced into the reading position through an upper portion 32A of the conveying path 32. The guide flap 46 has a blade having such a shape that allows the posture to change easily on contact with a document conveyed from the connecting position 38 to the intersecting position 40 on the switchback path 39. Accordingly, the document conveyed from the dead end 41 to the intersecting position 40 on the switchback path 39 can be easily guided into the reading position on the conveying path 32. As described above, the guide flap 46 is changed in posture when a document is brought into contact therewith. Accordingly, a necessity of positively allowing the guide flap 46 to change in posture by giving thereto a driving force of a motor 67 can be eliminated. Thus, the configuration of the guide flap 46 becomes simple.

The guide flap 47 is disposed so as to move rotationally in a predetermined range around a shaft 49 provided on a corner (the right side in FIG. 3) between the sheet feed tray 30 on the conveying path 32 and the dead end 41 on the switchback path 39 at an intersecting position 40. The guide flap 47 is a substantially blade-shaped flat plate, and the leading end thereof projects to the intersecting position 40. Only one guide flap 47 is indicated in FIG. 2 and FIG. 3. However, a plurality of the same-shaped guide flaps 47 may be provided at predetermined intervals in the width direction of the conveying path 32, and the plurality of guide flaps 47 can be moved rotationally in an integrated manner.

The guide flap 47 is moved rotationally around the shaft 49. The guide flap 47 is changed in posture, that is, a fifth guiding posture shown by the solid line and a sixth guiding posture shown by the double chained line in FIG. 3. The guide flap 47 is brought into contact with a guide member of the conveying path 32 or that of the switchback path 39, for example. Thereby, the guide flap 47 prevents the guide member from being moved rotationally to the right side in FIG. 3 from the fifth guiding posture or above in FIG. 3 from the sixth guiding posture. When the guide flap 47 is changed into the fifth guiding posture, a conveying route from the dead end 41 on the switchback path 39 to the reading position on the conveying path 32 is continuously connected and also a conveying route from the connecting position 38 on the switchback path 39 to the sheet feed tray 30 on the conveying path 32 is closed. Thereby, a document arriving from the dead end 41 on the switchback path 39 at an intersecting position 40 advances into the reading position on the conveying path 32 and is prevented from advancing into the sheet feed tray 30. Further, a document arriving from the connecting position 38 on the switchback path 39 at the intersecting position 40 advances into the dead end 41 on the switchback path 39 and is prevented from advancing into the sheet feed tray 30 on the conveying path 32.

When the guide flap 47 is changed into the sixth guiding posture, a conveying route from the sheet feed tray 30 on the conveying path 32 to the conveying route at the reading position is continuously connected and also a conveying route from the sheet feed tray 30 on the conveying path 32 to the dead end 41 on the switchback path 39 is closed. Thereby, a document arriving from the sheet feed tray 30 on the conveying path 32 at the intersecting position 40 advances into the reading position on the conveying path 32 and is prevented from advancing into the dead end 41 on the switchback path 39.

The conveying route change by the guide flap 47 is performed by document contact. The guide flap 47 is constantly in a fifth guiding posture as shown by the solid line in FIG. 3 due to its own weight or under a force urged by an elastic member such as springs. When a document conveyed from the sheet feed tray 30 on the conveying path 32 is brought into contact with the guide flap 47, the guide flap 47 is moved rotationally so as to be pushed to the left side in FIG. 3 and changed into a sixth guiding posture as shown by the double chained line in FIG. 3. In contrast, assuming that the document conveyed from the connecting position 38 on the switchback path 39 to the intersecting position 40 is brought into contact with the guide flap 47, the guide flap 47 is prevented from being moved rotationally to the right side in FIG. 3 from the fifth guiding posture. Therefore, the document is guided by the guide flap 47 and is advanced into the dead end 41 on the switchback path 39. The guide flap 47 has a blade having such a shape that allows the posture change easily on contact with a document conveyed from the sheet feed tray 30 to the intersecting position 40 on the conveying path 32 and the document conveyed from the connecting position 38 to the intersecting position 40 on the switchback path 39 can be easily guided into the dead end 41 on the switchback path 39. As described above, the guide flap 47 is changed in posture when a document is brought into contact therewith, thereby eliminating a necessity of positively allowing the guide flap 47 to change in posture by giving thereto a driving force of a motor 67. Thus, the configuration of the guide flap 46 becomes simple.

As shown in FIG. 2 and FIG. 4, a guide flap 50 is disposed at a connecting position 38. The guide flap 50 is disposed so as to move rotationally around a shaft 51 and receives a driving force of a motor 67 to move rotationally in a first guiding posture as shown by the solid line and in a second guiding posture as shown by the double chained line in FIG. 4. The guide flap 50 is brought into contact with a guide member of the conveying path 32 or that of the switchback path 39, for example. Thereby, the guide flap 50 is prevented from being moved rotationally upward in FIG. 4 from the first guiding posture and below in FIG. 4 from the second guiding posture. When the guide flap 50 is in the first guiding posture, a conveying route from the reading position (the left side in FIG. 4) to the sheet discharge tray 31 (the right side in FIG. 4) on the conveying path 32 is continuously connected. Thereby, a document which has passed through the reading position is guided into the connecting position 38 toward the sheet discharge tray 31 at a lower portion 32C on the conveying path 32. When the guide flap 50 is in the second guiding posture, a conveying route from downstream at the reading position of the lower portion 32C on the conveying path 32 to the switchback path 39 is continuously connected. Thereby, the document which has passed through the reading position is guided into the connecting position 38 so as to advance into the switchback path 39. Therefore, the guide flap 50 is disposed at the connecting position 38 so as to guide the document into either the conveying path 32 or the switchback path 39. Further, only one guide flap 50 is shown in FIG. 2 and FIG. 4. However, in reality, a plurality of identically shaped guide flaps 50 are provided at predetermined intervals in the width direction of the conveying path 32 and the plurality of guide flaps 50 are moved rotationally in an integrated manner.

As shown in FIG. 2, the conveying path 32 and the switchback path 39 have a plurality of sensors which detect the conveying of documents. More specifically, the conveying path 32 has a first front sensor 52 and a second front sensor 53 respectively upstream and downstream of the separation roller 34. Further, a rear sensor 54 is disposed immediately upstream at a reading position of the conveying path 32. A switchback sensor 55 is disposed between the connecting position 38 and the intersecting position 40 of the switchback path 39 on the conveying path 32. These sensors are so-called optical sensors and configured in the same manner, except a detecting element is different in a shape depending on a detecting position. The configuration will be described with reference to the first front sensor 52.

As shown in FIG. 5, the first front sensor 52 is composed of a detecting element 56 and a photo interrupter 57 which detects rotational movement of the detecting element 56. The detecting element 56 is projected from the lower face of the conveying path 32. The detecting element moves rotationally around a shaft 59 so as to retreat from the conveying path 32 upon contact with a document. An insulation portion 58, which is detected by the photo interrupter 57, is formed integrally at the detecting element 56. The detecting element 56 is elastically urged by an urging unit such as springs (not shown) at a position where the detecting element 56 projects on the conveying path 32, that is, in a counter-clockwise direction as shown in FIG. 5. When no external force is applied to the detecting element 56, as shown by the solid line in FIG. 5, the detecting element 56 is projected on the conveying path 32 and the insulation portion 58 is located between a light emitting portion and a light receiving portion of the photo interrupter 57. Thereby, light transmitted by the photo interrupter 57 is blocked, and the first front sensor 52 is turned off.

When a document is placed on the sheet feed tray 30, the document is brought into contact with a detecting element 56, and the detecting element 56 is moved rotationally in the counterclockwise direction so as to retreat from the conveying path 32. The insulation portion 58 is also moved rotationally, together with the detecting element 56. As shown by the double chained line in FIG. 5, the insulation portion 58 departs from a space between the light emitting portion and the light receiving portion of the photo interrupter 57. Thereby, light transmitted by the photo interrupter 57 is not blocked, and the first front sensor 52 is turned on. The first front sensor 52 is turned on or off, thereby detecting whether a document is placed on the sheet feed tray 30.

The second front sensor 53 detects the leading end or the trailing end of a document conveyed to the conveying path 32 with reference to a fact that the sensor is turned on or off. For example, conveying rollers 35A, 35B, 35C and 35D are monitored for the number of rotations with reference to the number of steps of an encoder or a motor 67 after the second front sensor 53 detects the trailing end of the document, thereby judging a position of the leading end or the trailing end of the document on the conveying path 32.

The rear sensor 54 disposed immediately upstream in the reading position detects the leading end or the trailing end of a document conveyed to the conveying path 32 with reference to a fact that the sensor is turned on or off. Conveying rollers 35A, 35B, 35C and 35D are monitored for the number of rotations with reference to the number of steps of an encoder or a motor 67 after the rear sensor 54 detects the leading end or the trailing end of the document. Thereby, it is judged whether the leading end or the trailing end of the document has arrived at the reading position. Image reading by an image reading unit 22 is controlled on the basis of signals sent from the rear sensor 54. Therefore, when the leading end of the document arrives at the reading position, image reading is started, and when the trailing end of the document arrives at the reading position, image reading is completed.

A switchback sensor 55 is disposed between a connecting position 38 and an intersecting position 40 on a switchback path 39. The switchback sensor 55 detects the leading end or the trailing end of a document conveyed through the switchback path 39 with reference to a fact that the sensor is turned on or off. For example, conveying rollers 35A, 35B, 35C and 35D and the switchback roller 43 are monitored for the number of rotations with reference to the number of steps of an encoder or a motor 67 after the switchback sensor 55 detects the trailing end of the document. Thereby, it is judged whether the trailing end of the document has passed through the intersecting position 40.

Figure 6:
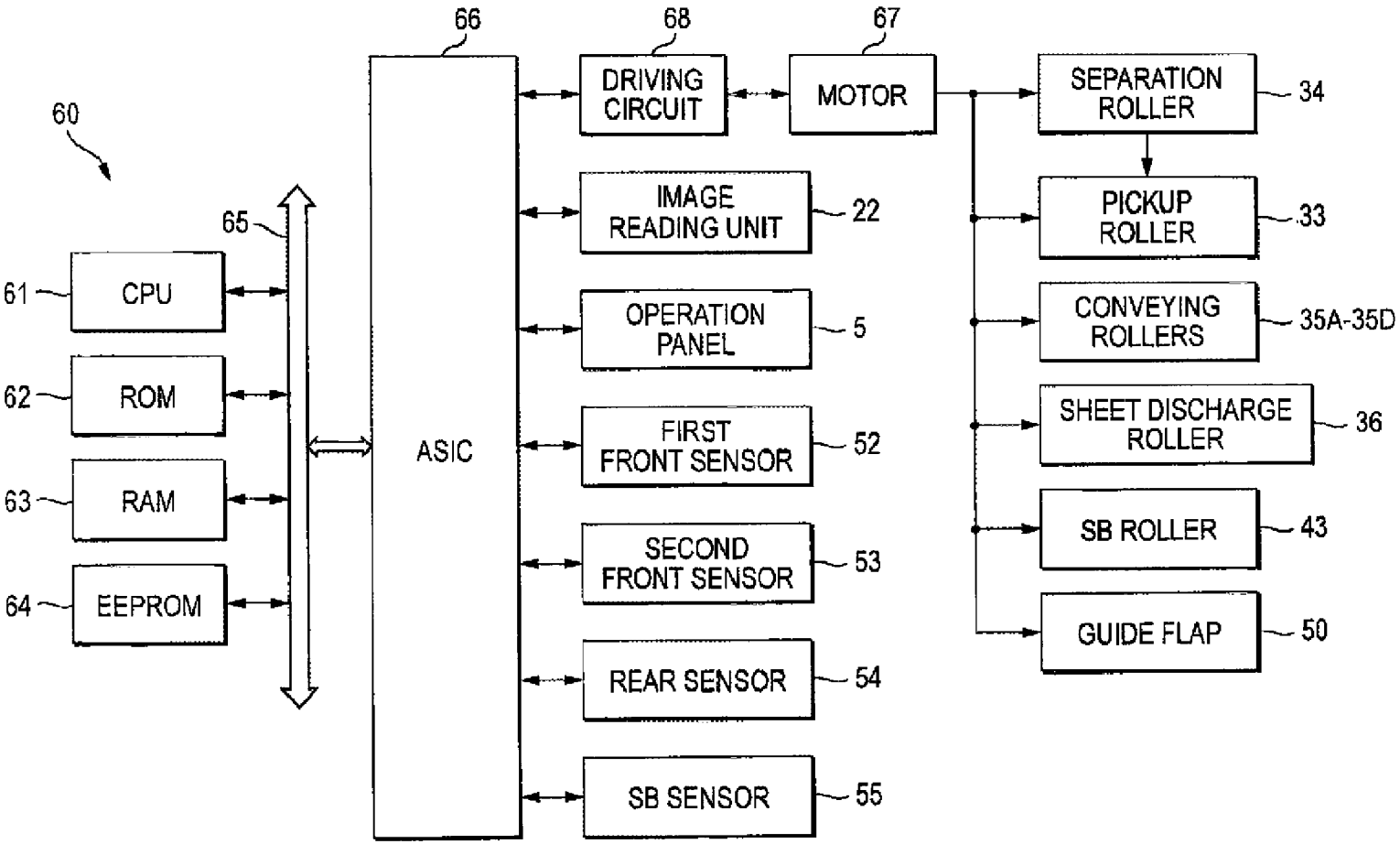
FIG. 6 is a block diagram showing a control portion.

FIG. 6 is a view showing a configuration of a control portion 60 functioning as a control unit of the image reading device 1. As shown in FIG. 6, the control portion 60 is configured as a micro computer including a CPU (central processing unit) 61, a ROM (read only memory) 62, a RAM (random access memory) 63 and an EEPROM (electrically erasable and programmable ROM) 4. The control portion 60 is connected to an application-specific integrated circuit (ASIC) 66 via a bus 65.

The ROM 62 stores programs and the like which control various motions of the image reading device 1. The RAM 63 is used as a storage area or a work area temporarily storing various data used when the CPU 61 executes the above programs. The EEPROM 64 is a storage area which stores various installations and flags to be recorded, after the power supply is turned off.

The ASIC 66 controls the rotation of the motor 67 by generating a mutual excitation signal and the like supplied to a motor 67 in compliance with instructions from the CPU 61, imparting the signal to a driving circuit 68 of the motor 67 and supplying a driving signal to the motor 67 via the driving circuit 68. The motor 67 rotates forward and backward and imparts a driving force to the pickup roller 33, the separation roller 34, conveying rollers 35A, 35B, 35C and 35D, the sheet discharge roller 36, the switchback roller (SB roller) 43 and the guide flap 50. In other words, the motor 67 functions as a driving source of the ADF 3.

The driving circuit 68 generates an electric signal for rotating the motor 67 in response to an output signal from the ASIC 66 and drives the motor 67. When The motor 67 rotates at a predetermined speed in a predetermined direction in response to the electric signal, a rotating force of the motor 67 is transmitted respectively via driving-force transmitting mechanisms to the pickup roller 33, the separation roller 34, conveying rollers 35A, 35B, 35C and 35D, the sheet discharge roller 36, the switchback roller 43 and the guide flap 50.

The ASIC 66 is connected with an image reading unit 22 which reads images on a document conveyed by the ADF 3 to a reading position. On the basis of control programs stored into the ROM 62, the image reading unit 22 reads images of the document. Although not shown in FIG. 6, a driving mechanism for reciprocating the image reading unit 22 is also driven in response to an output signal from the ASIC 66.

The ASIC 66 is connected with a first front sensor 52, a second front sensor 53, a rear sensor 54 and a switchback sensor (SB sensor) 55. In response to these sensors which are turned on or off, the CPU 61 allows the ASIC 66 to output a predetermined output signal on the basis of control programs stored into the ROM 62 in order to actuate the motor 67 and the image reading unit 22.

When a driving force is transmitted from the motor 67 respectively through the driving force transmitting mechanisms to the pickup roller 33, the separation roller 34, conveying rollers 35A, 35B, 35C and 35D, the sheet discharge roller 36 and the switchback roller 43, each of the rollers is driven and rotated at a predetermined peripheral speed (speed on the roller surface which is equivalent to a document conveying speed). As described above, documents are conveyed at a predetermined conveying speed on the conveying path 32 or the switchback path 39 in accordance with a peripheral speed of each of these rollers.

The conveying rollers 35A, 35B are set in a way such that a peripheral speed of the conveying roller 35A is faster than that of conveying roller 35B. In other words, assuming that a peripheral speed of the conveying roller 35A is given as Va and that of the conveying roller 35B is given as Vb, the relationship of Va>Vb is obtained. Therefore, when the document is conveyed by the conveying rollers 35A and 35B, the document is deflected between the conveying rollers 35A and 35B.

The conveying rollers 35B, 35C and 35D are set in a way such that a peripheral speed of the conveying roller 35C arranged immediately upstream from a reading position is slower than that of the conveying rollers 35B and 35D. In other words, assuming that a peripheral speed of the conveying roller 35C is given as Vc and that of the conveying roller 35D is given as Vd, the relationship of Vb>Vc<Vd is obtained. Therefore, when the document is conveyed by the conveying rollers 35B and 35C, the document is deflected between the conveying rollers 35B and 35C. Further, when the document is conveyed by the conveying rollers 35C and 35D, tension is applied to the document, and the document is pulled by the conveying roller 35D.

Regarding the relationship between the conveying roller 35D and the switchback roller 43, a peripheral speed of the switchback roller 43 is set substantially equal to that of the conveying roller 35D. In other words, assuming that a peripheral speed of the switchback roller 43 is given as Vs, the relationship of Vd≅Vs is obtained. Therefore, a document conveyed by the conveying roller 35D is nipped between the switchback roller 43 and the pinch roller 44. Thus, tension applied to the document can be constant.

As to the relationship between the conveying roller 35B and the switchback roller 43, a peripheral speed of the switchback roller 43 is set to be faster than that of the conveying roller 35B. In other words, assuming that a peripheral speed of the switchback roller 43 is given as Vs, the relationship of Vb<Vs is obtained. Therefore, a document conveyed by the conveying roller 35B and the switchback roller 43 is deflected between the conveying roller 35B and the switchback roller 43.

The conveying rollers 35A, 35B, 35C and 35D and the switchback roller 43 can be made different in peripheral speed in an easy and simple manner, for example, with consideration given to a diameter of each of these rollers. In other words, assuming that a diameter (a distance between one roller shaft to another roller shaft) of each of these conveying rollers 35A, 35B, 35C and 35D is given as Ra, Rb, Rc or Rd, the relationship of Ra>Rb may be provided for satisfying the relationship of Va>Vb. Further, in order to satisfy the relationship of Vb>Vc<Vd, the relationship of Rb>Rc<Rd may be provided. Similarly, assuming that a diameter of the switchback roller 43 is given as Rs, the relationship of Rd≅Rs) may be provided for satisfying the relationship of Vd≅Vs). Further, in order to satisfy the relationship of Vb<Vs, the relationship of Rb<Rs may be provided. Thereby, when the rotation substantially at an equal speed is transmitted to each of the rollers via a driving-force transmitting mechanism from a single motor 67, a peripheral speed can be easily and simply set with reference to a diameter of each of the rollers.

Incidentally, the difference in peripheral speed of each of the conveying rollers 35A, 35B, 35C, 35D and the switchback roller 43 shall not be restricted to an example where the difference is set with reference to a diameter of each of the rollers. For example, it may adjust the gear ratio of a driving-force transmitting mechanism for transmitting a driving force of the motor 67 to each of the conveying rollers 35A, 35B, 35C and 35D and the switchback roller 43.

Hereinafter, a description will be made for motions in reading images by the present image reading device 1.

The image reading device 1 may be used as an FBS and also as the ADF 3. However, a detailed description will be omitted here for a case where the FBS is used because such use is not related to this aspect. When the ADF 3 is used, the document cover 4 is kept closed with respect to the document placing base 2. Opening and closing of the document cover 4 is detected by a sensor and the like mounted on the document placing base 2. The ADF 3 is controlled to be available when the document cover is closed. A document Gn to be read is placed on a sheet feed tray 30. The document Gn is placed on a sheet feed tray 30 such that a face to be read (first side) is kept on top, keeping the documents in a so-called face-up configuration. The document Gn may be placed in plurality or as a singular sheet. For example, when a plurality of documents Gn with the same size are read for images, the documents are stacked on the sheet feed tray 30 in a way such that a first sheet of the document G1 can be placed, that is, with the first side being face-up.

When a signal of "start reading" is input into the image reading device 1, the motor 67 is driven to rotate and drive the pickup roller 33, the separation roller 34, the conveying rollers 35A, 35B, 35C and 35D, the sheet discharge roller 36 and the switchback roller 43 at a predetermined timing. Further, an arm 29 is lowered and the pickup roller 33 press contacts with a document G1 on the sheet feed tray 30. Then, documents are picked up one sheet at a time starting from the uppermost document G1 which directly receives a rotating force of the pickup roller 33 and that of the separation roller 34 and conveyed to a conveying path 32. The supplied documents Gn are guided into the conveying path 32 and conveyed to a reading position where the documents Gn are read for images by an image reading unit 22 on standby below the reading position. Then, the documents Gn completed for image reading are discharged to the sheet discharge tray 31. In the above-described image reading motions, a conveying route of the documents Gn is different depending on whether the documents Gn are read for images on one face only or on both sides. Whether the documents Gn are read for images on one face only or on both sides will be judged in a one-face reading mode or a double-sided reading mode previously set prior to inputting the signal of start reading.

Figure 7:
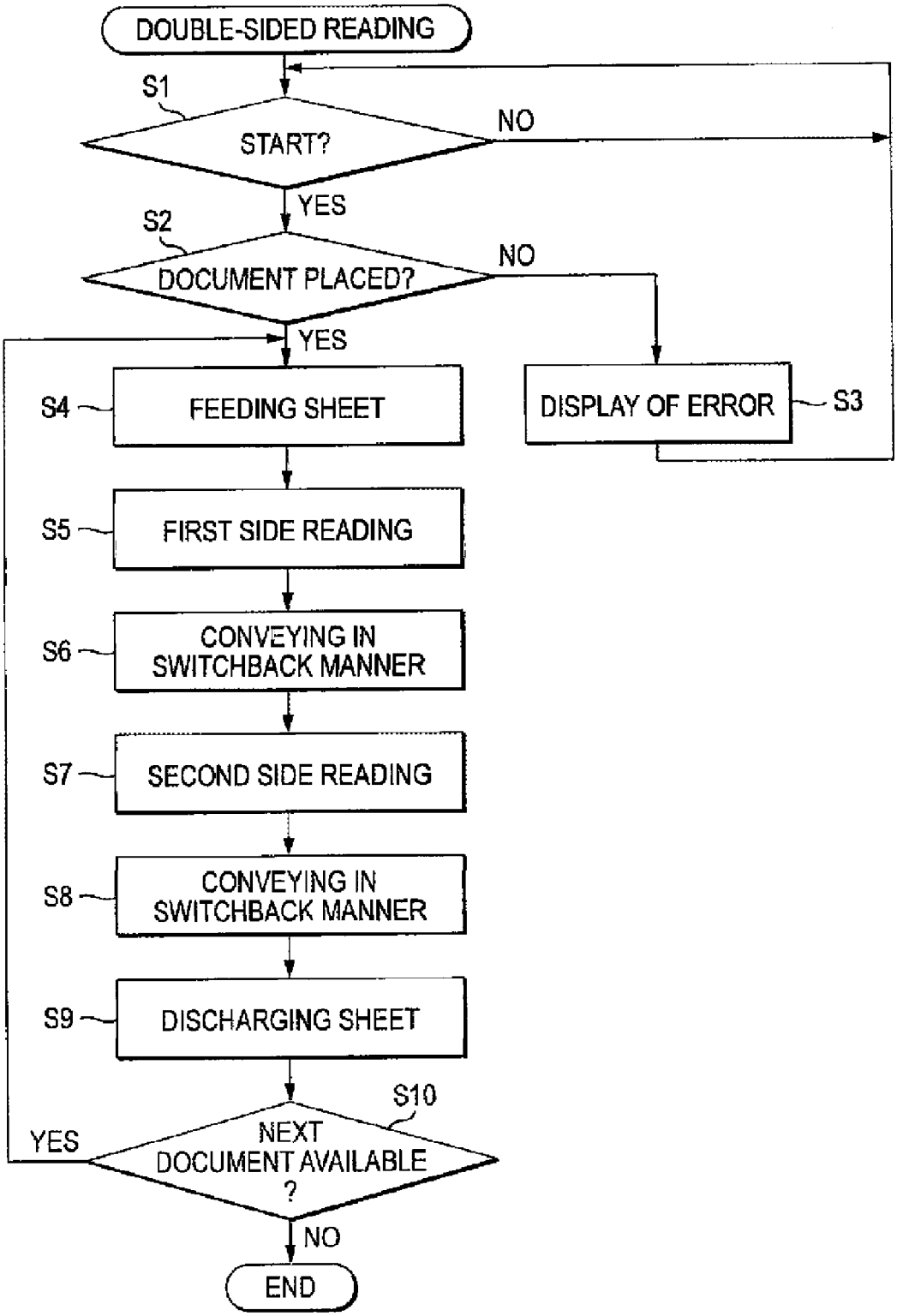
FIG. 7 is a flowchart showing the process of reading images on both sides of the document by the image reading device.
Figure 8:
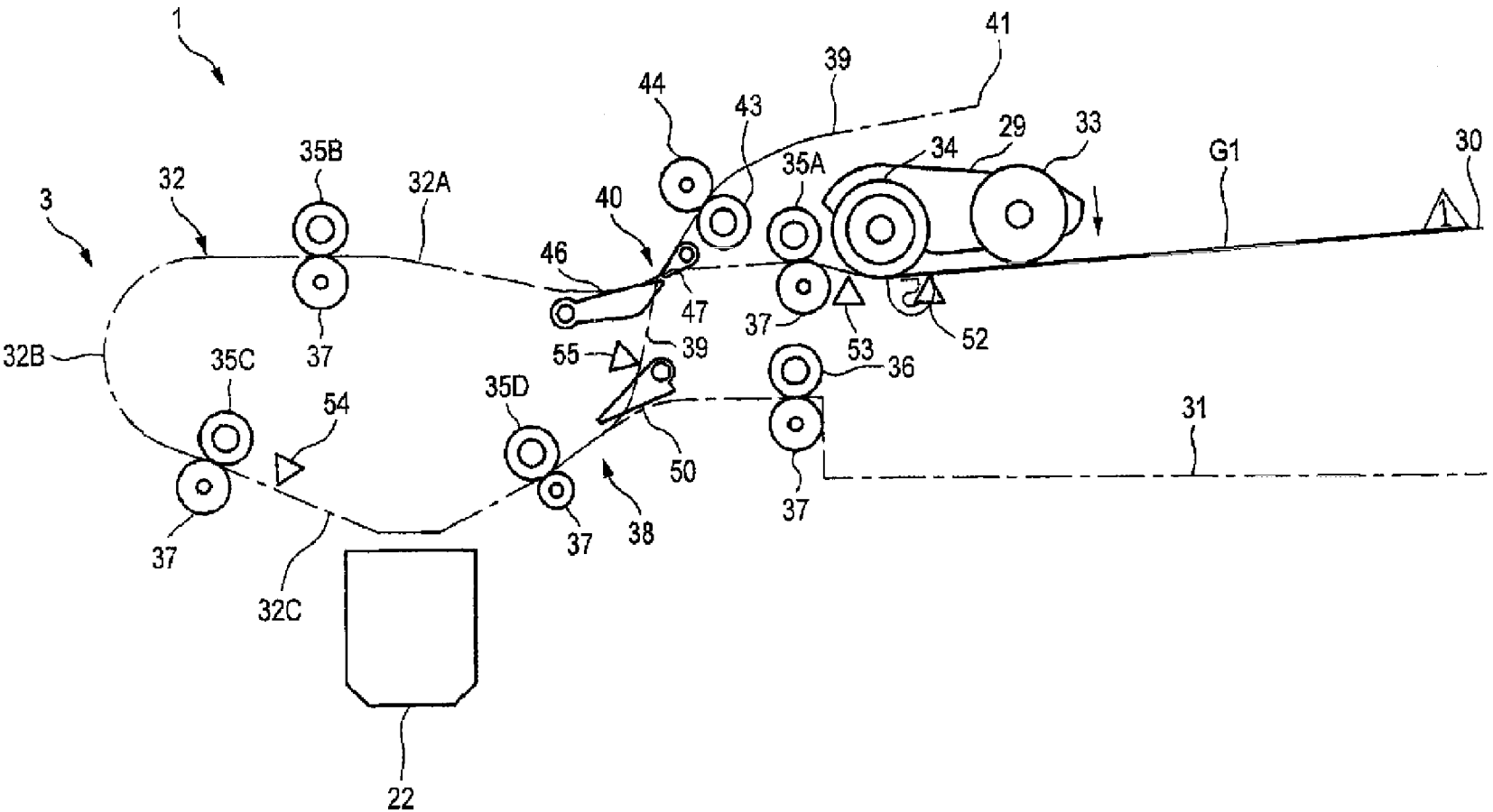
FIG. 8 is a pattern diagram showing motions of reading images in a double-sided reading mode.

Hereinafter, a description will be made for the double-sided reading mode. FIG. 7 is a flowchart showing motions of the image reading device 1 in the double-sided reading mode. FIG. 8 through FIG. 14 are pattern diagrams showing a conveying state of documents Gn upon reading images on both sides. Before the documents Gn are fed, as shown in FIG. 8, a guide flap 50 is in a position such that a conveying route at the connecting position 38 is continuously connected from a reading position on the conveying path 32 to the sheet discharge tray 31. A guide flap 46 is in a position such that the conveying route at a third guiding posture or at an intersecting position 40 is connected from the sheet feed tray 30 on the conveying path 32 to the reading position. A guide flap 47 is in a position such that the conveying route at a fifth guiding posture or at the intersecting position 40 is connected from the dead end 41 on the switchback path 39 to the reading position at the conveying path 32. It is noted that the face indicated as "1" on the documents Gn is a first side which will be read first when images are read on both sides, and the face indicated as "2" is a second side which will be read later. The first side is a front of the second side, or the second side is a back of the first side.

When the signal of start reading is input into an image reading device 1 (S1(Y)), a first front sensor 52 detects whether documents Gn are placed on a sheet feed tray 30 or not (S2). When a control portion 60 judges that no documents Gn are placed on the sheet feed tray 30 (S2(N)), an error display indicating no documents is made at a liquid crystal portion 12 on an operation panel 5 in the image reading device 1 (S3). When the documents Gn are placed on the sheet feed tray 30 (S2(Y)), a motor 67 is driven at a predetermined speed to feed the document G1 (S4).

More specifically, the control portion 60 not only drives the motor 67 but also lowers the arm 29. Thereby, the pickup roller 33 press contacts with the document G1 on the sheet feed tray 30. When a driving force is transmitted from the motor 67 to rotate the pickup roller 33 and the separation roller 34 in a sheet feed direction, the document G1 runs into the conveying path 32. When a plurality of documents Gn are placed on the sheet feed tray 30, there may be a case where a document G2 immediately below the uppermost document G1 may be sent out together with the document G1. However, the document G2 is prevented from being sent out by a separation pad mounted at a position opposite the separation roller 34.

A driving force is transmitted from the motor 67 to the conveying rollers 35A, 35B, 35C and 35D and the sheet discharge roller 36 at a predetermined timing on the conveying path 32. Thereby, each of the rollers rotates in a sheet feed direction so as to feed documents Gn from upstream to downstream on the conveying path 32. The document G1 conveyed from the sheet feed tray 30 to the conveying path 32 is nipped by a conveying roller 35A and a pinch roller 37, receives a rotating force and is conveyed to an intersecting position 40 on the conveying path 32. When the document G1 is conveyed to the conveying path 32, a second front sensor 53 is turned on.

Figure 9:
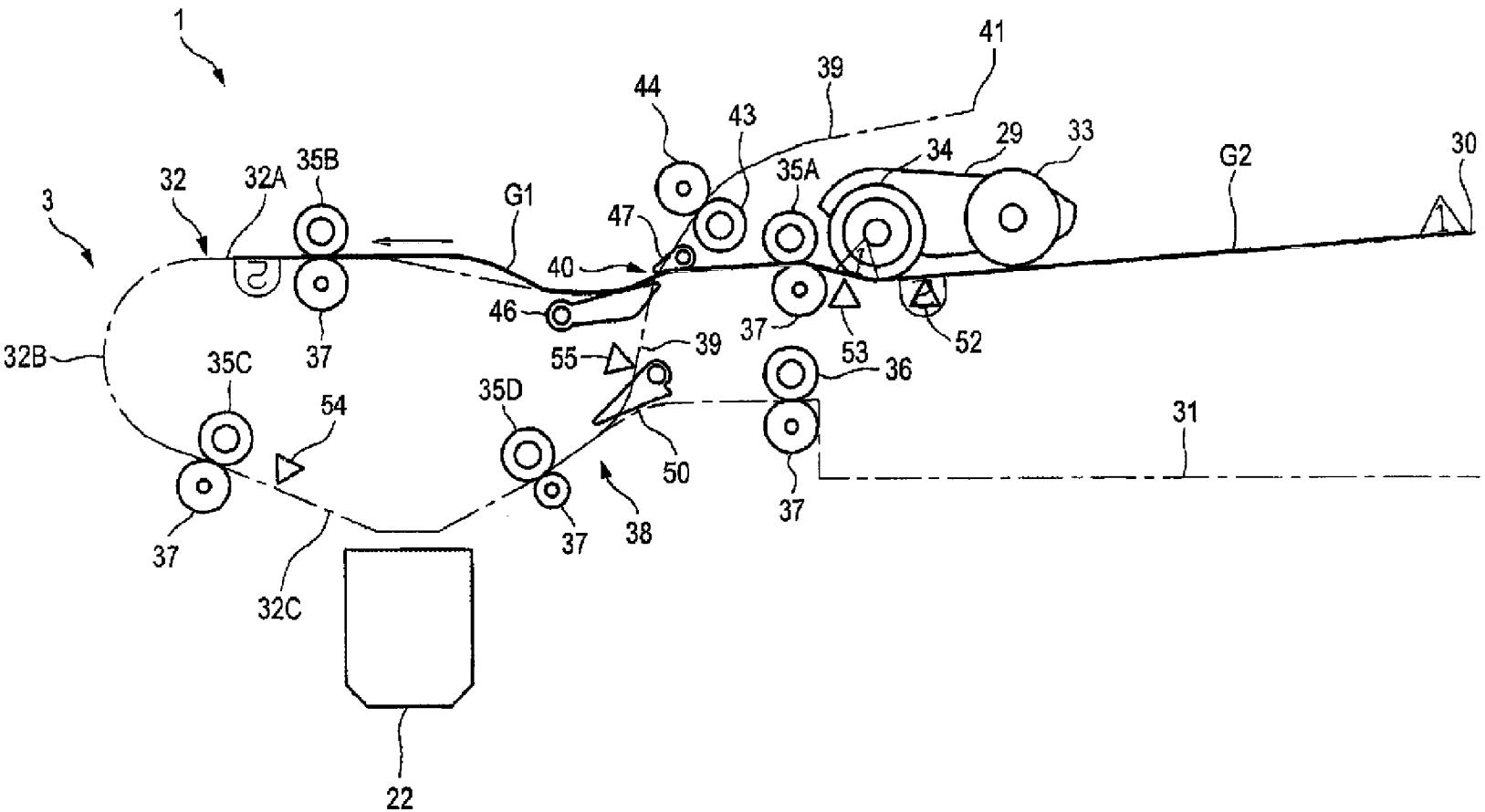
FIG. 9 is a pattern diagram showing motions of reading images in the double-sided reading mode.

Since a guide flap 47 closes a conveying route from the sheet feed tray 30 on the conveying path 32 to an intersecting position 40, the document G1 conveyed to the intersecting position 40 is brought into contact with the guide flap 47. As shown in FIG. 9, the guide flap 47 is moved rotationally so as to be pushed toward the document G1 conveyed on the conveying path 32, and changed from a fifth guiding posture into a sixth guiding posture. Thereby, a conveying route is continuously connected from the sheet feed tray 30 on the conveying path 32 to the reading position, and a conveying route to the dead end 41 on the switchback path 39 is closed. Further, a conveying route to the connecting position 38 on the switchback path 39 is closed by the guide flap 46. Therefore, the document G1 arriving from the sheet feed tray 30 on the conveying path 32 at an intersecting position 40 is guided by the guide flap 46 and the guide flap 47 and conveyed to the reading position on the conveying path 32 without advancing into either of the directions on the switchback path 39.

The document G1 conveyed from the intersecting position 40 to the reading position on the conveying path 32 is conveyed with the leading end of the document in a sheet feed direction nipped by the conveying roller 35B. As described above, peripheral speeds of the conveying rollers 35A and 35B are expressed as the relationship of Va>Vb. Thus, the document G1, in which the leading end thereof in the sheet feed direction is nipped between the conveying roller 35B and the pinch roller 37 and the trailing end thereof in the sheet feed direction is nipped between the conveying roller 35A and pinch roller 37, deforms so as to deflect between the conveying rollers 35A and 35B. Thereby, the document G1 is corrected for bias conveyance.

Each of the conveying rollers 35A, 35B, 35C and 35D and the sheet discharge roller 36 are set to be faster in peripheral speed than that of the separation roller 34. Thus, the separation roller 34 is idled by the document G1 nipped and conveyed by the conveying roller 35A and the pinch roller 37 while making a press contact with the separation roller 34, by which there develops a predetermined clearance in a sheet feed direction between a first sheet of the document G1 and a second sheet of the document G2. After a second front sensor 53 detects the trailing end of the document G1 in a sheet feed direction and is turned off, a control portion 60 cuts off a driving force transmitted to the pickup roller 33 and the separation roller 34. Thereby, the document G2 is not conveyed from the sheet feed tray 30 to the conveying path 32 but retained on the sheet feed tray 30.

Figure 10:
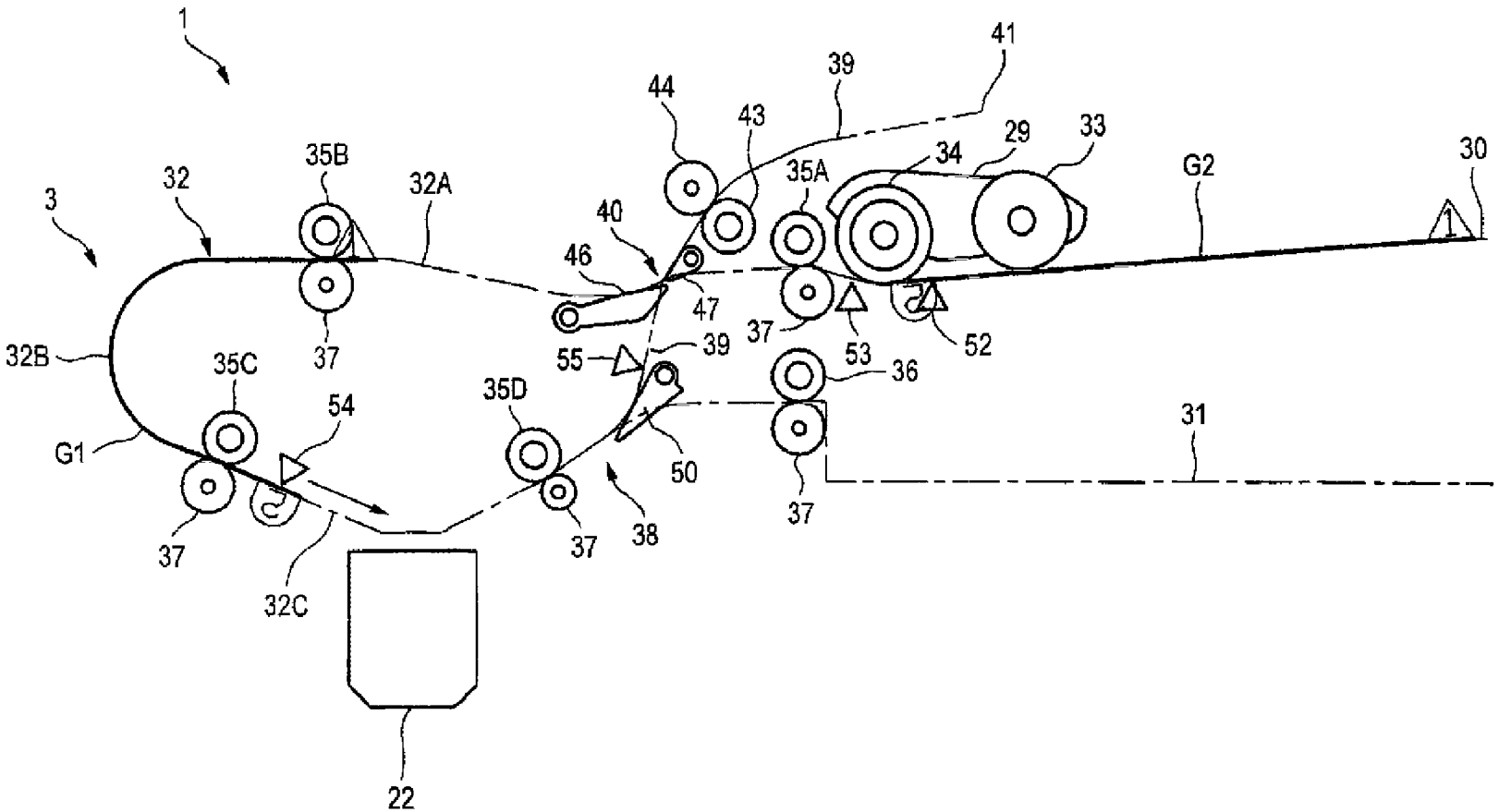
FIG. 10 is a pattern diagram showing motions of reading images in the double-sided reading mode.

As shown in FIG. 10, the document G1 is conveyed below a curved portion 32B of the conveying path 32 so as to reverse a sheet feed direction, and the leading end thereof in the sheet feed direction is nipped between the conveying roller 35C and the pinch roller 37. As described above, among the conveying rollers 35B, 35C and 35D, the conveying roller 35C is the slowest in peripheral speed and rotated so as to give the relationship of Vb>Vc<Vd. Therefore, the document G1 conveyed, with the leading end in the sheet feed direction nipped between the conveying roller 35C and the pinch roller 37 and also the trailing end in the sheet feed direction nipped between the conveying roller 35B and the pinch roller 37 is deflected between the conveying rollers 35B and 35C. Thereby, the document G1 is not adhered on an inner guide face of the curved portion 32B on the conveying path 32 but smoothly conveyed along an outer guide face of the curved portion 32B so as to be reversed downward.

A rear sensor 54 is turned on when detecting the leading end of the document G1 in the sheet feed direction. The leading end of the document G1 in the sheet feed direction arrives at a reading position after a predetermined time has passed from the detection by the rear sensor 54. Therefore, when the leading end of the document G1 in the sheet feed direction arrives at the reading position, a control portion 60 activates an image reading unit 22 to read images of the document G1. The document G1 is guided by a guide face of the reading guide 45 to pass through the reading position, with the first side opposed to the image reading unit 22, and images on the first side of the document G1 are read by the image reading unit 22 (S5). Further, when images of the document G1 are read, the document G1 is conveyed while the leading end in the sheet feed direction is nipped between the conveying roller 35D and the pinch roller 37 and the trailing end in the sheet feed direction is nipped between the conveying roller 35C and the pinch roller 37. As described above, peripheral speeds of the conveying rollers 35C and 35D are expressed as the relationship of Vc<Vd. Thus, the document G1 conveyed by the conveying rollers 35C and 35D is pulled by the conveying roller 35D and conveyed while a predetermined tension is applied thereto. Thereby, the document G1 is curved between the conveying rollers 35C and 35D so as to bulge downward along the guide face of the reading guide 45 and conveyed over the reading position at a constant speed without generating any extra deflection.

Figure 11:
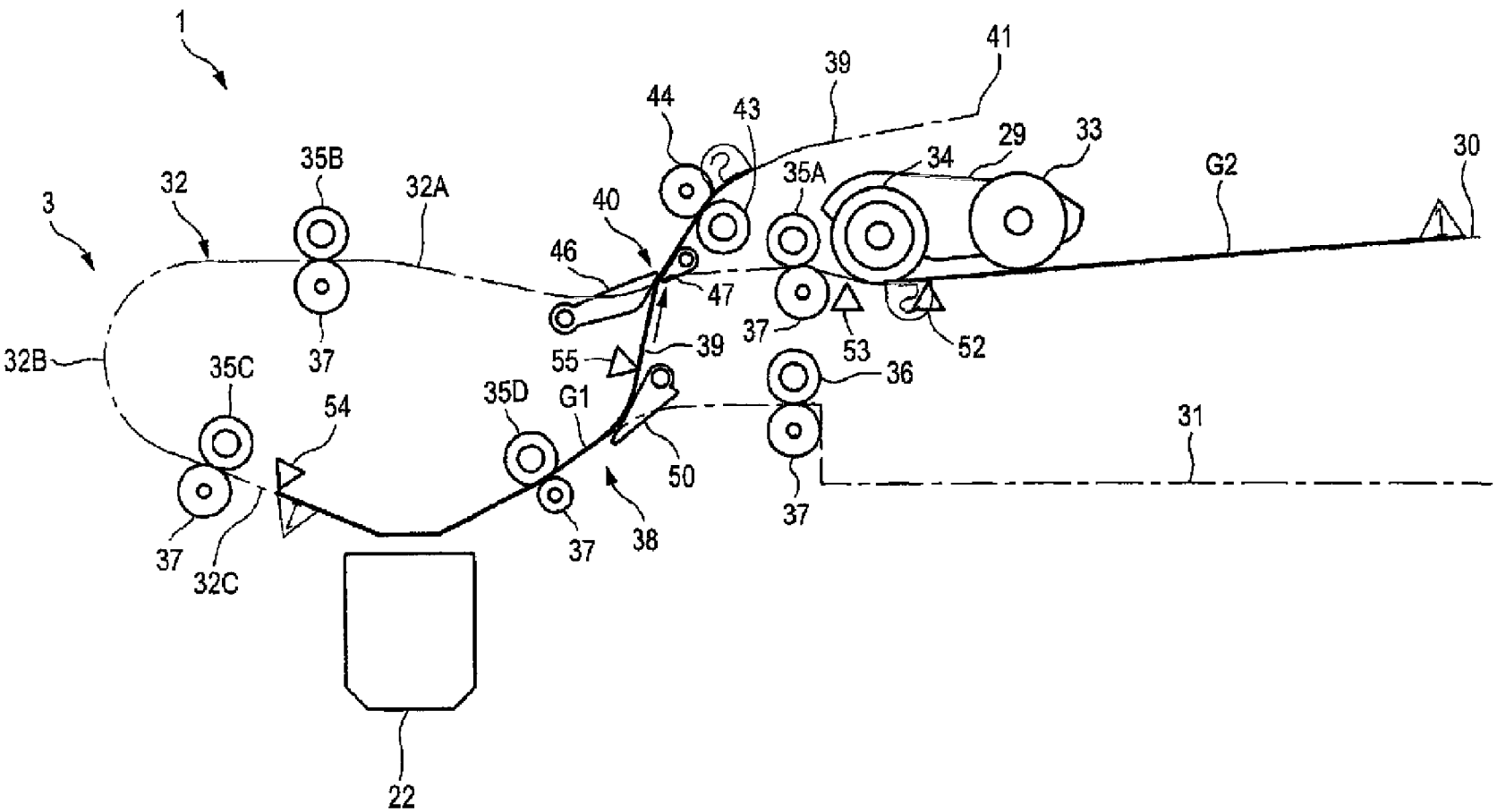
FIG. 11 is a pattern diagram showing motions of reading images in the double-sided reading mode.

As shown in FIG. 11, the leading end of the document G1 in the sheet feed direction for which images on the first side have been read is conveyed in a switchback manner (S6), the document is guided by a guide flap 50 and is advanced from a conveying path 32 into a switchback path 39 over a connecting position 38. The guide flap 50 is changed into a second guiding posture at any given timing by the time when the document G1 arrives at the connecting position 38. Since the switchback path 39 is extended upward from a tangent line 70 at a nipping position 71 of the conveying roller 35D, the document G1 which has advanced into the switchback path 39 is guided so as to warp upward from the connecting position 38. The switchback sensor 55 is turned on when detecting the leading end of the document G1 in the sheet feed direction that has advanced into the switchback path 39.

Since a conveying route from a switchback path 39 to an intersecting position 40 is closed by the guide flap 46, the leading end of the document G1 in the sheet feed direction which has advanced into the switchback path 39 is brought into contact with the guide flap 46 in arriving at the intersecting position 40. The guide flap 46 is, as shown in FIG. 11, moved rotationally so as to be pushed upward by the leading end of the document G1 in the sheet feed direction which is conveyed on the switchback path 39, and changed from a third guiding posture into a fourth guiding posture. Thereby, a conveying route from the connecting position 38 on the switchback path 39 to the dead end 41 on the switchback path 39 is continuously connected, and a conveying route to the reading position on the conveying path 32 is closed. Further, a conveying route to the sheet feed tray 30 on the conveying path 32 is closed by the guide flap 47. Therefore, the leading end of the document G1 in the sheet feed direction which has arrived from the connecting position 38 on the switchback path 39 at the intersecting position 40 is guided by the guide flap 46 and the guide flap 47 and conveyed to the dead end 41 on the switchback path 39 without advancing into the conveying path 32.

The leading end of the document G1 in the sheet feed direction, which has advanced into the dead end 41 on the switchback path 39 over the intersecting position 40, is nipped between a switchback roller 43 and a pinch roller 44 rotating in a pulling-in direction. As described above, peripheral speeds of the conveying roller 35D and the switchback roller 43 are expressed as the relationship of $Vd \cong Vs$. Therefore, the leading end of the document G1 in the sheet feed direction conveyed by the conveying roller 35D is more quickly nipped between the switchback roller 43 and the pinch roller 44.

As shown in FIG. 11, when the leading end of the document G1 in the sheet feed direction is nipped between the switchback roller 43 and the pinch roller 44, the trailing end of the document G1 in the sheet feed direction is conveyed opposed to the reading position, and images are read by an image reading unit 22. The leading end of the document G1 in the sheet feed direction is nipped more quickly between the switchback roller 43 and the pinch roller 44. Thus, the trailing end of the document G1 in the sheet feed direction, which is opposed to the reading position, is conveyed without any trouble when the document G1 is nipped between the switchback roller 43 and the pinch roller 44.

The document G1 is conveyed on the switchback path 39 while the leading end in the sheet feed direction is nipped between the switchback roller 43 and the pinch roller 44 and the trailing end in the sheet feed direction is nipped between the conveying roller 35D and the pinch roller 37. Since the peripheral speed Vs of the switchback roller 43 is equivalent to a peripheral speed Vd of the conveying roller 35D, the document G1 is conveyed being nipped between the switchback roller 43 and the pinch roller 44. Accordingly, the conveying speed of the document G1 can be constant. Further, a nipping pressure applied to the document G1 by the switchback roller 43 and the pinch roller 44 is lower than that applied to the document G1 by the conveying roller 35D and the pinch roller 37. Therefore, the document G1 nipped between the switchback roller 43 and the pinch roller 44 is slidable, even when a difference in diameter of these rollers or the like causes a slight difference between the peripheral speed Vd and the peripheral speed Vs of the conveying roller 35D and imparting tension to the document G1 by which it is pulled toward the sheet feed direction by the switchback roller 43 and the pinch roller 44. Therefore, the trailing end of the document G1 in the sheet feed direction, which is opposed to the reading position, is conveyed over the reading position at a constant speed by the conveying roller 35D and the pinch roller 37.

When the document G1 is further conveyed, the trailing end of the document G1 in the sheet feed direction, which is conveyed over the reading position, passes through a nipping position of the conveying roller 35C and the pinch roller 37. Thereby, tension applied to the document G1 between the conveying rollers 35C and 35D is temporarily released. Consequently, the trailing end of the document G1 in the sheet feed direction is moved from a guide face of the reading guide 45 to a platen glass 21. This behavior of the document G1 is expected from a difference between the peripheral speed Vc and the peripheral speed Vd of the conveying roller 35C and the conveying roller 35D. Further, a clearance between the guide face of the reading guide 45 and the platen glass 21 is determined previously. Since the peripheral speed Vs of the switchback roller 43 is equivalent to the peripheral speed Vd of the conveying roller 35D, the document G1 guided by a switchback path 39 so as to warp upward is nipped and conveyed by the switchback rollers 39, thereby causing no influence resulting from a difference between the peripheral speed Vc of the conveying roller 35C and the peripheral speed Vd of the conveying roller 35D. Further, tension applied to the document G1 between the conveying rollers 35C and 35D can be stable. Thereby, behavior of the trailing end of the document G1 in the sheet feed direction found when passing through a nipping position of the conveying roller 35C and the pinch roller 37 is made stable as expected initially from a difference in the peripheral speed between the conveying roller 35C and the conveying roller 35D. The document G1 can be conveyed without any trouble resulting from unstable behavior of the document G1 at the reading position on the basis of other factors.

A rear sensor 54 is turned off when detecting the trailing end of the document G1 in the sheet feed direction. A control portion 60 finishes reading images on the first side of the document G1 by an image reading unit 22 after a predetermined time has passed since the rear sensor 54 is turned off. Image data of the first side read by the image reading unit 22 is stored into a RAM 63 of the control portion 60.

Figure 12:
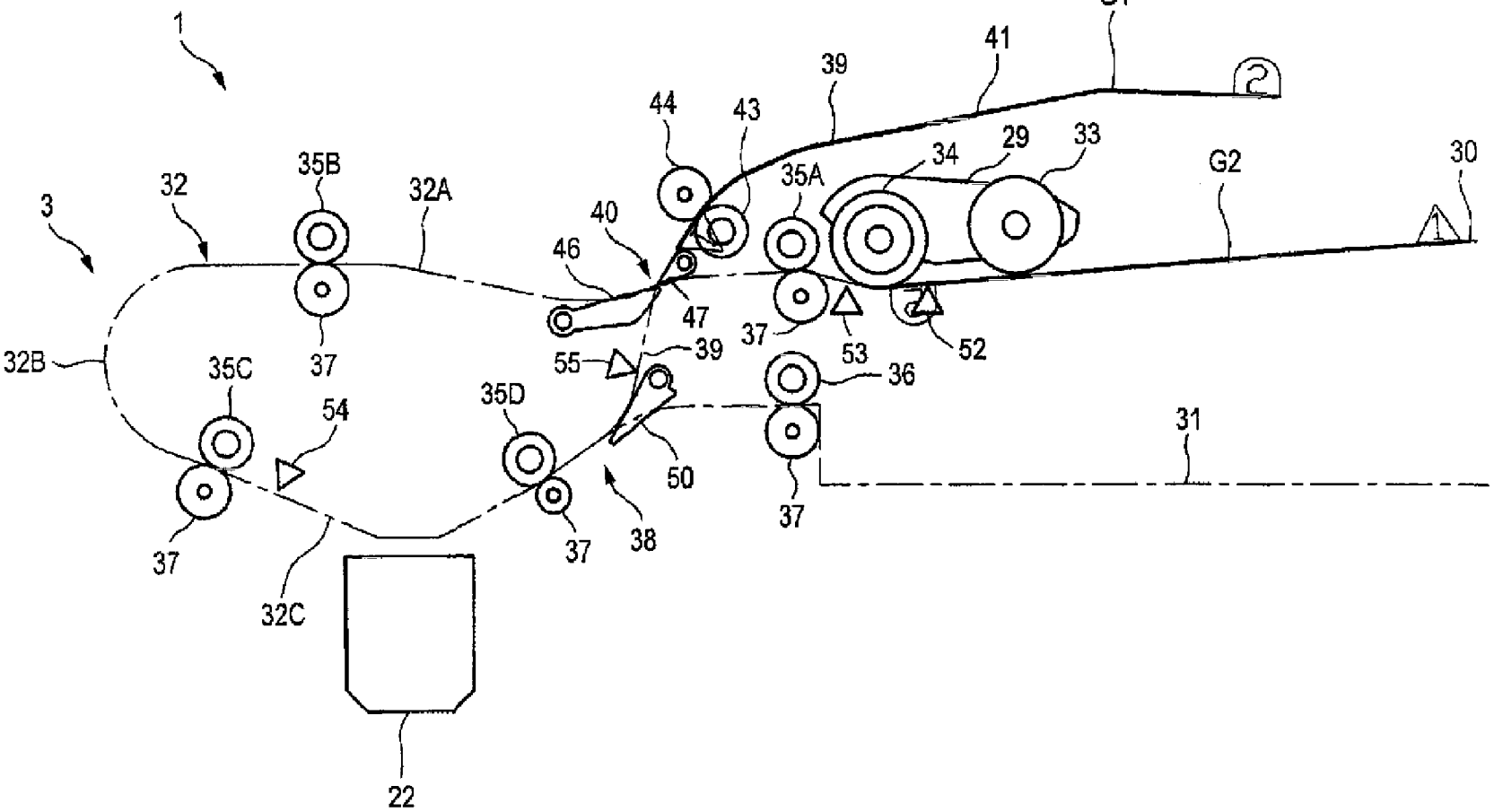
FIG. 12 is a pattern diagram showing motions of reading images in the double-sided reading mode.

As shown in FIG. 12, after the trailing end of the document G1 in the sheet feed direction has moved beyond an intersecting position 40 on the switchback path 39 and advanced into a dead end 41, a control portion 60 changes the rotating direction of a motor 67. A switchback sensor 55 is turned off when detecting the trailing end of the document G1 in the sheet feed direction which is conveyed on the switchback path 39, and the trailing end of the document G1 in the sheet feed direction passes through the intersecting position 40 after a predetermined time has passed. Therefore, the control portion 60 judges that the trailing end of the document G1 in the sheet feed direction has moved beyond the intersecting position 40 on the switchback path 39 and completely advanced into the dead end 41 with reference to a signal detected by the switchback sensor 55 and counting the distance or the time of documents conveyed by the conveying roller 35D and the switchback roller 43. When the rotating direction of the motor 67 is changed, the document G1 nipped by the switchback roller 43 and the pinch roller 44 and projected from the dead end 41 is returned to the intersecting position 40. In other words, the document G1 is conveyed in a switchback manner so as to return to the intersecting position 40 on the switchback path 39 (S6).

When a part of the document G1 is moved from the dead end 41 on the switchback path 39 out side the ADF 3, the projecting part of the document G1 is supported by the document supporting portion 42. However, the leading end of the document G1 in the sheet feed direction projected from the document supporting portion 42 hangs downward. When conveying in a switchback manner, the document G1 is conveyed so as to be pulled inside from the dead end 41. Therefore, the switchback roller 43 and the pinch roller 44 are required to have a nipping force sufficient in holding therebetween the hanging document G1 and conveying it in a switchback manner. Further, when the document G1 passes through the intersecting position 40 and leaves from a guide flap 46, the guide flap 46 is moved rotationally downward and returned to a third guiding posture.

Figure 13:
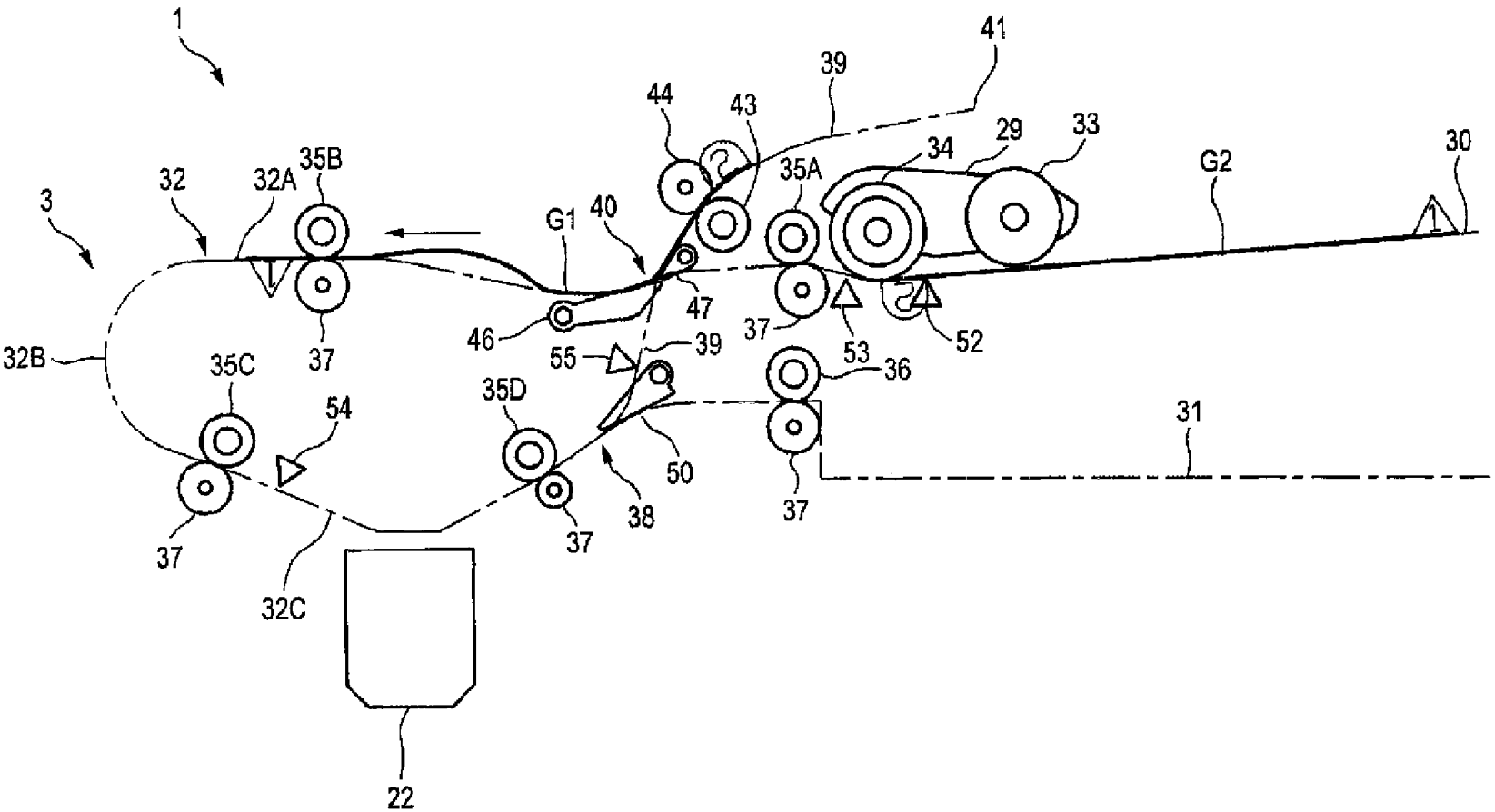
FIG. 13 is a pattern diagram showing motions of reading images in the double-sided reading mode.

As shown in FIG. 13, the document G1 returned from the switchback path 39 is brought into contact with the guide flap 46 at the third guiding posture in an intersecting position 40. The guide flap 46 is controlled so as not to move rotationally downward from the third guiding posture. Therefore, a conveying route 32 from the dead end 41 on the switchback path 39 to a reading position on the conveying path 32 is continuously connected, and also a conveying route to a connecting position 38 on the switchback path 39 is closed. Further, a conveying route to the sheet feed tray 30 on the conveying path 32 is closed by a guide flap 47. Therefore, the document G1 is guided by the guide flap 46 and the guide flap 47 and conveyed from the dead end 41 on the switchback path 39 to the reading position on the conveying path 32 without advancing into the connecting position 38 on the switchback path 39 or the sheet feed tray 30 on the conveying path 32. The document G1 is returned from the switchback path 39 to the reading position on the conveying path 32 and is sent again to the conveying path 32 in a state that the leading end and the trailing end of the document are reversed with each other from a state that the document was first conveyed on the conveying path 32. As described above, the document G1 is conveyed in a switchback manner.

The document G1 conveyed in a switchback manner and returned to the conveying path 32 is conveyed while the leading end in the sheet feed direction is nipped between the conveying roller 35B and the pinch roller 37 and the trailing end in the sheet feed direction is nipped between the switchback roller 43 and the pinch roller 44. As described above, since a peripheral speed of the conveying roller 35B and that of the switchback roller 43 are expressed as the relationship of $Vb<Vs$, the document G1 is deformed so as to deflect between the conveying roller 35B and the switchback roller 43. Thereby, the document G1 is corrected for bias conveyance. A pulling force toward the sheet feed direction, which is applied to the document G1 conveyed in a switchback manner, that is, tension, is also decreased. Therefore, a resist mechanism is realized for correcting bias conveyance of documents Gn conveyed in a switchback manner by the conveying roller 35B and the pinch roller 37 as well as by the switchback roller 43 and the pinch roller 44.

Figure 14:
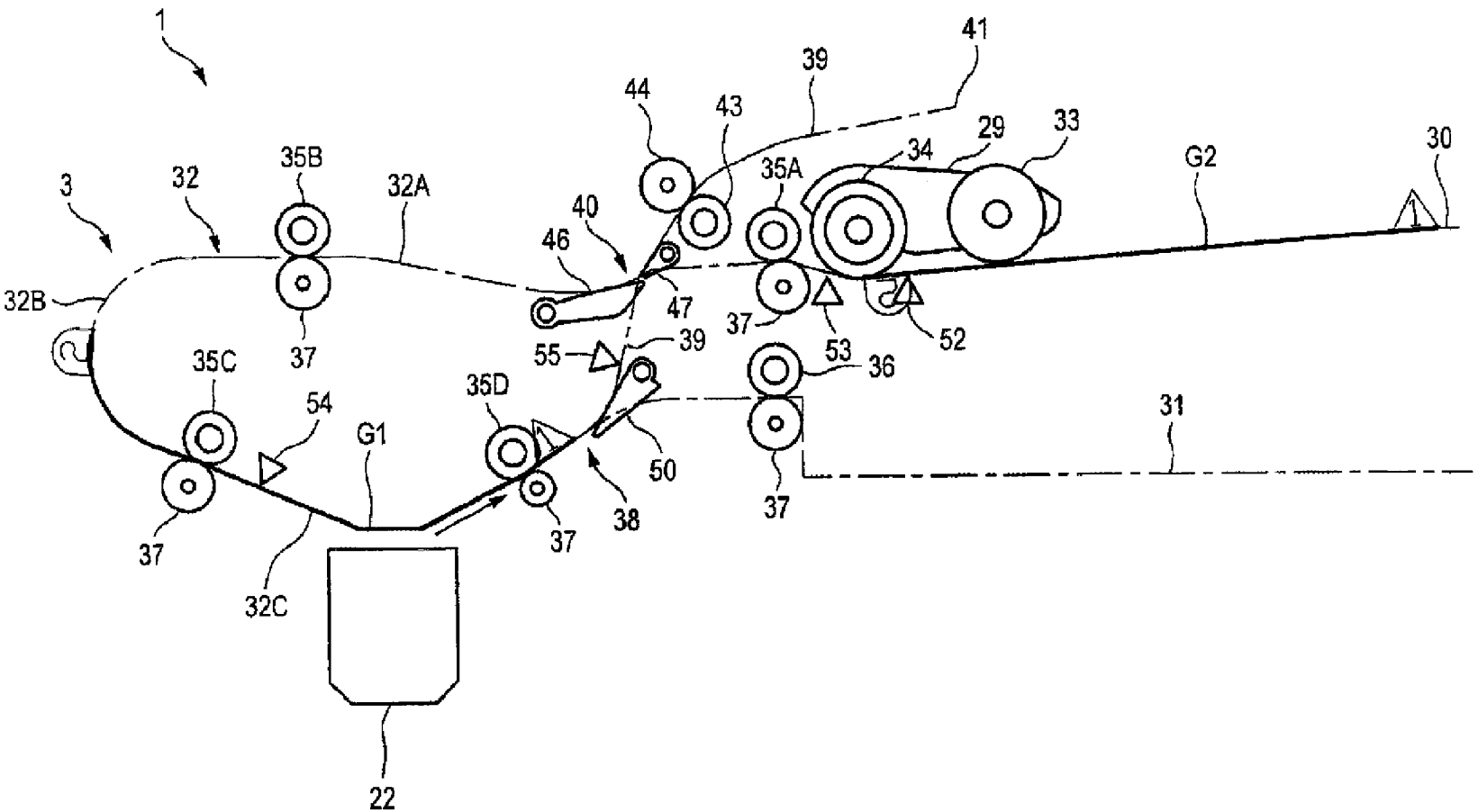
FIG. 14 is a pattern diagram showing motions of reading images in the double-sided reading mode.
Figure 15:
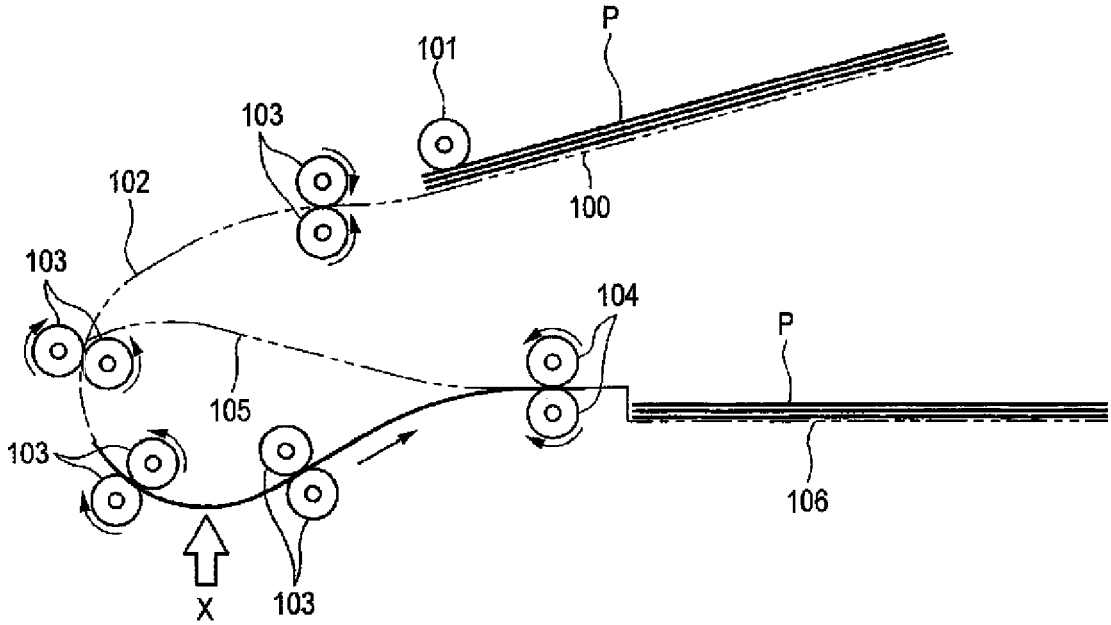
FIG. 15 is a pattern diagram showing document conveyance to be read for images on both sides of a document by a related automatic document feeder.
Figure 16:
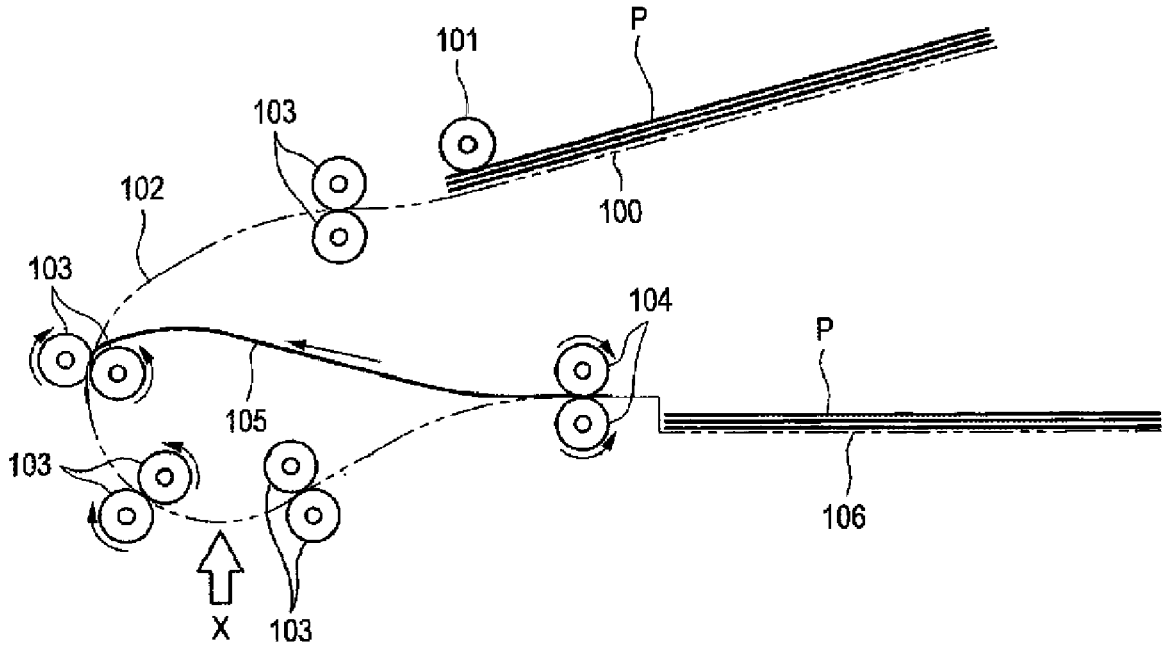
FIG. 16 is a pattern diagram showing document conveyance to be read for images on both sides of a document by the related automatic document feeder.

The document G1 corrected for bias conveyance is conveyed downward along the curved portion 32B on the conveying path 32 so as to reverse the sheet feed direction, and the leading end in the sheet feed direction is detected by a rear sensor 54. When the leading end of the document G1 in the sheet feed direction arrives at a reading position, as shown in FIG. 14, the control portion 60 allows an image reading unit 22 to read images on the second side of the document G1 (S7). The document G1 is guided by the reading guide 45, passing through the reading position, with the second side opposed to the image reading unit 22, and images on the second side of the document G1 are read by the image reading unit 22.

In reading images on the second side of the document G1, the leading end of the document G1 in the sheet feed direction, which has advanced over an intersecting position 40 into the dead end 41 on the switchback path 39, is nipped between the switchback roller 43 and the pinch roller 44 rotating in a pulling-inside direction. However, as described above, since a peripheral speed of the conveying roller 35D is equivalent to that of the switchback roller 43 ($Vd \cong Vs$), the leading end of the document G1 in the sheet feed direction, which is conveyed by the conveying roller 35D, is more quickly nipped between the switchback roller 43 and the pinch roller 44. Therefore, when reading images on the second side as well, the trailing end of the document G1 in the sheet feed direction, which is opposed to the reading position, can also be conveyed without any trouble.

Further, as with a case of reading images on the first side of the document G1, a peripheral speed Vs of the switchback roller 43 is equivalent to a peripheral speed Vd of the conveying roller 35D, and the document G1 is nipped between the switchback roller 43 and the pinch roller 44. Thereby, the conveying speed of the document G1 can be stable.

Still further, since the peripheral speed Vs of the switchback roller 43 is equivalent to the peripheral speed Vd of the conveying roller 35D, the document G1 guided so as to warp upward from the switchback path 39 is nipped and conveyed by the switchback rollers 39 and conveyed, thereby causing no influence resulting from a difference between the peripheral speed Vc and the peripheral speed Vd of the conveying rollers 35C and 35D. Further, tension can be stable. As a result, behavior of the trailing end of the document G1 in the sheet feed direction passing through a nipping position of the conveying roller 35C and the pinch roller 37 are made stable as expected initially from a difference in the peripheral speed between the conveying rollers 35C and 35D. The document G1 is conveyed without any trouble resulting from unstable behavior of the document G1 at the reading position on the basis of other factors.

A rear sensor 54 is turned off, when detecting the trailing end of the document G1 in the sheet feed direction. A control portion 60 finishes reading images on the second side of the document G1 by an image reading unit 22 after a predetermined time has passed since the rear sensor 54 is turned off. Image data of the second side read by the image reading unit 22 is stored into a RAM 63 of the control portion 60.

The document G1, the second side of which has been read for images is again conveyed in a switchback manner to conform the page direction (S8). The document G1 is conveyed in the switchback manner similar to the above. In other words, the document G1 which has advanced into the switchback path 39 and arrived at an intersecting position 40 is moved rotationally so as to push up the guide flap 46 similarly in the state as shown in FIG. 11, changed from the third guiding posture into the fourth guiding posture, thereby advances over the intersecting position 40 into the dead end 41 on the switchback path 39. Similarly in a state as shown in FIG. 12, after the trailing end of the document G1 in the sheet feed direction has moved beyond the intersecting position 40 on the switchback path 39 and completely advanced into the dead end 41, a control portion 60 changes the rotating direction of a motor 67, rotates the switchback roller 43 in a returning direction, thereby returns the document G1 to the intersecting position 40. Then, similarly in a state shown in FIG. 13, the document G1 returned from the switchback path 39 is guided by the guide flap 46 and the guide flap 47, and conveyed from the dead end 41 on the switchback path 39 to a reading position on the conveying path 32. Thereby, the document G1 is sent again on the conveying path 32 in the state that the leading end and the trailing end of the document are reversed with respect to each other, or in the state that the document was first fed to the conveying path 32.

Thereafter, the document G1 passes through the reading position, with the first side opposed thereto. In this instance, a rear sensor 54 is turned on when the rear sensor 54 detects the document G1. However, this conveyance is to discharge a plurality of documents Gn placed on the sheet feed tray 30 to the sheet discharge tray 31 while keeping the order of the thus placed documents as they are. Thus, the control portion 60 does not give instructions for reading images of the document G1.

The document G1 which has arrived at a connecting position 38 is guided by a guide flap 50 over the connecting position 38 into the sheet discharge tray 31, and conveyed to the sheet discharge tray 31 by the sheet discharge roller 36 with the first side facing downward. The guide flap 50 is changed into a first guiding posture at any given timing by the time when the document G1 arrives at the connecting position 38. The document G1 is nipped between the sheet discharge roller 36 and the pinch roller 37 and discharged into the sheet discharge tray 31, with the first side facing downward (S9).

After completely reading images on both sides of the document G1, the control portion 60 judges whether the document G2 to be read for images is placed on the sheet feed tray 30 (S10). When a next document G2 is placed on the sheet feed tray 30, a first front sensor 52 is turned on. When the control portion 60 judges that the document G2 is placed thereon (S10 (Y)), the control portion 60 transmits a driving force from the motor 67 to the sheet feed roller 33 and the separation roller 34 for rotating them. Thereby, the document G2 on the sheet feed tray 30 is conveyed into the conveying path 32, and images are read on both sides, as with the document G1. In contrast, the control portion 60 finishes actions of reading images on both sides, where documents Gn to be read for images are not available (S10 (N)).

As described above, with the ADF 3 of the present aspect, the document Gn is nipped and conveyed by the conveying roller 35D arranged downstream from a reading position and conveyed at a document conveying speed higher than that of the conveying roller 35C arranged upstream from the reading position. Thus, the document Gn curved so as to bulge downward to the reading position receives tension along the reading guide 45 on the conveying path 32. Accordingly, no deflection develops at the reading position.

Further, documents are nipped and conveyed by the switchback roller 43 arranged on the switchback path 39 extended upward from a tangent line 70 at a nipping position 71 of the conveying roller 35D at a conveying force equivalent to that of the conveying roller 35D. The document Gn is nipped between the switchback roller 43 and the pinch roller 44, by which no changes develop in the conveying speed of the document Gn at a reading position or in tension, and behavior is made stable, which is found when the trailing end of the document Gn in the sheet feed direction passes through a nipping position of the conveying roller 35C and the pinch roller 37. Thereby, the document Gn can be conveyed at a conveying accuracy appropriate for reading images at the reading position.

Further, the document Gn is nipped between the switchback roller 43 and the pinch roller 44 at a nipping pressure lower than that of the conveying roller 35D and the pinch roller 37. Thus, when a load occurs on the document Gn with regard to the relationship between the conveying roller 35D and the pinch roller 37 as well as that between the switchback roller 43 and the pinch roller 44, the document G1 nipped between the switchback roller 43 and the pinch roller 44 slides at first. Thereby, the document Gn opposed to the reading position is conveyed without fail at a difference in peripheral speed between the conveying roller 35C and the conveying roller 35D and behavior at the reading position is stabilized to a greater extent.

Further, the dead end 41 on the switchback path 39 is opened outside the ADF 3, and the document Gn conveyed in a switchback manner by the switchback roller 43 and the pinch roller 44 partially moves from the dead end 41 out of the ADF 3, then hanging down outward. Therefore, the switchback roller 43 and the pinch roller 44 are required to have a nipping pressure sufficient to support and pull up the document Gn for conveying in a switchback manner. In this instance, the previously described effect is provided markedly. When another conveying roller pair is provided on the dead end 41 side from the switchback roller 43 on the switchback path 39, the switchback roller 43 and the pinch roller 44 may be made weaker in nipping pressure than a case where the document Gn is supported and pulled up solely by a conveying roller pair.

The document Gn is conveyed along the reading guide 45 at a reading position in a state that tension is applied by the conveying rollers 35C and 35D and each of the pinch rollers 37. The document Gn which has passed through a connecting position 38 is guided so as to warp upward by the switchback path 39. Therefore, if the document Gn is conveyed being nipped between the switchback roller 43 and the pinch roller 44 thereby providing additional tension to the document Gn at the reading position, the reading guide 45 is retreated from the reading position against an elastic urging force by an increase in tension. When the trailing end of the document Gn in the sheet feed direction has passed through a nipping position between the conveying roller 35C and the pinch roller 37, the tension is temporarily released, thereby allowing the reading guide 45 to return to the reading position. Such behavior of the reading guide 45 may cause the document Gn to behave unstably. However, in the present ADF 3, the document Gn is conveyed being nipped between the switchback roller 43 and the pinch roller 44, causing no change in tension of the document Gn at the reading position. Also behavior is made stable, which is found when the trailing end of the document Gn in the sheet feed direction has passed through the nipping position between the conveying roller 35C and the pinch roller 37.

Further, a difference in the peripheral speed between the conveying rollers 35B, 35C and 35D, and the switchback roller 43 for conveying documents accurately by the image reading device 1 and realizing a resist mechanism may be set appropriately depending on a distance between rollers and others. It is considered that the peripheral speed has a difference ranging from substantially 0.1 to 1%, for example.

In this aspect, a description has been made for motions of reading images on both sides by the image reading device 1 on the assumption that a plurality of documents Gn placed on a sheet feed tray 30 are discharged to a sheet discharge tray 31 according to the order of the thus placed documents. When there is no need in making the order of documents Gn placed on the sheet feed tray 30 in conformity with the order of the documents Gn discharged on the sheet discharge tray 31, the documents are conveyed, with the second side of the document Gn opposed to the reading position, thereafter, the documents Gn may be conveyed over the connecting position 38 to the sheet discharge tray 31 and discharged to the sheet discharge tray 31, without allowing the documents Gn to advance again into the switchback path 39. Thereby, although the order of the documents Gn is not kept as they are on the sheet discharge tray 31, a last step of conveying the documents in a switchback manner can be omitted. Thereby, the time necessary for reading images from both sides of the documents Gn can be shortened. Further, discharging of the document G1 and supplying the document G2 may be processed at the same time in order to shorten the conveying time when images are continuously read from both sides of the plurality of documents Gn.

Further, when a one-face reading mode is set, a control portion 60 rotates a motor 67 and the document Gn is conveyed from the sheet feed tray 30 to the conveying path 32. When the document Gn arrives at a reading position, images on the first side are read. Then, upon passage of the document Gn through the reading position, the document Gn is discharged by the sheet discharge roller 36 to the sheet discharge tray 31. As shown in this aspect where a conveying path from the conveying roller 35D to the sheet discharge roller 36 is formed downstream from the tangent line 70, assuming that the peripheral speed Ve of the sheet discharge roller 36 is set faster than the peripheral speed Vd of the conveying roller 35D, the document Gn guided into the conveying path is given a horizontal tension. Therefore, when the trailing end of the document Gn in the sheet feed direction has passed through a nipping position of the conveying roller 35C and the pinch roller 37, there is hardly found a change in behavior in the vertical direction on the document Gn and the thus read images are not markedly deteriorated in quality. Further, even when a conveying path from the conveying roller 35D to the sheet discharge roller 36 is formed upstream from the tangent line 70, it is possible to provide similar effects as described above by setting the peripheral speed Ve of the sheet discharge roller 36 equivalent to the peripheral speed Vd of the conveying roller 35D. In other words, a post-reading conveying path is not restricted to the switchback path 39 but may include a conveying path reaching the sheet discharge tray 31 as long as it is extended upstream from the tangent line 71.

What is claimed is:

1. A document feeder comprising:

a conveying path which is extended from a document supplying position in a predetermined direction, curved downward so as to reverse a sheet feed direction and reaching a reading position, the conveying path guiding a document from the reading position to a reverse sheet feed direction which is opposed to the sheet feed direction;

a first conveying roller pair which is provided upstream in the sheet feed direction from the reading position of the conveying path and is provided above the reading position, the first conveying roller pair nipping and conveying the document passing through the conveying path;

a second conveying roller pair which is provided downstream in the sheet feed direction from the reading position of the conveying path and is provided above the reading position, the second conveying roller pair nipping and conveying the document passing through the conveying path at a document conveying speed faster than the first conveying roller pair;

a post-reading conveying path which is provided in the conveying path and is extended from a nipping position of the second conveying roller pair in a downstream direction, the post-reading conveying path being located above a plane tangent to the second conveying roller pair at the nipping position running in the reverse sheet feed direction; and a third conveying roller pair which is provided on the post-reading conveying path, the third conveying roller pair nipping and conveying the document conveyed from the second conveying roller pair at a conveying force equivalent to that of the second conveying roller pair, wherein an intersection portion of the conveying path with the post-reading conveying path is located in the reverse sheet feed direction from the nipping position of the second conveying roller pair, and wherein the post-reading conveying path is extended above the document supplying position.

2. The document feeder according to claim 1, wherein the third conveying roller pair is rotated at a peripheral speed equivalent to that of the second conveying roller pair.

3. The document feeder according to claim 1, wherein a conveying route from the first conveying roller pair on the conveying path reaching the third conveying roller pair is substantially in a shape of an S when viewed in a longitudinal direction.

4. The document feeder according to claim 1, wherein the third conveying roller pair conveys documents in a switchback manner.

5. The document feeder according to claim 4, wherein the post-reading conveying path has an opening at a dead end outside the document feeder, and wherein the third conveying roller pair conveys the document to an outside of the document feeder such that a part of the document projects outside from the opening, and wherein the third conveying roller conveys the document in the switchback manner.

6. The document feeder according to claim 5, wherein the third conveying roller pair conveys the document at least a part of which projects outside from the opening and deflects downward in the switchback manner.

7. The document feeder according to claim 1, wherein the conveying path is opposed to the reading position, and wherein the conveying path has a reading guide elastically urged so as to retreat from the reading position.

8. The document feeder according to claim 1, wherein the third conveying roller pair is located in the reverse sheet feed direction from the intersecting portion.

9. The document feeder according to claim 1 further comprising:

a controller configured to drive the first, second and third conveying roller pairs and to control the conveying force applied by each of the first, second and third conveying roller pairs such that the document conveying speed of the second conveying roller pair is faster than the document conveying speed of the first conveying roller pair.

10. A document feeder comprising:

a conveying path which is extended from a document supplying position in a predetermined direction, curved downward so as to reverse a sheet feed direction and reaching a reading position, the conveying path guiding a document from the reading position to a reverse sheet feed direction which is opposed to the sheet feed direction;

a first conveying roller pair which is provided upstream in the sheet feed direction from the reading position of the conveying path and is provided above the reading position, the first conveying roller pair nipping and conveying the document passing through the conveying path;

a second conveying roller pair which is provided downstream in the sheet feed direction from the reading position of the conveying path and is provided above the reading position, the second conveying roller pair nipping and conveying the document passing through the conveying path at a document conveying speed faster than the first conveying roller pair;

a post-reading conveying path which is provided in the conveying path and is extended from a nipping position of the second conveying roller pair in a downstream direction, the post-reading conveying path being located above a plane tangent to the second conveying roller pair at the nipping position running in the reverse sheet feed direction; and a third conveying roller pair which is provided on the post-reading conveying path, the third conveying roller pair nipping and conveying the document conveyed from the second conveying roller pair at a conveying force equivalent to that of the second conveying roller pair, wherein an intersection portion of the conveying path with the post-reading conveying path is located in the reverse sheet feed direction from the nipping position of the second conveying roller pair, and wherein the third conveying roller pair holds the document at a nipping pressure lower than that of the second conveying roller pair.

11. A document feeder comprising:

a conveying path which is extended from a document supplying position in a predetermined direction, curved downward so as to reverse a sheet feed direction and reaching a reading position, the conveying path guiding a document from the reading position to a reverse sheet feed direction which is opposed to the sheet feed direction;

a first conveying roller pair which is provided upstream in the sheet feed direction from the reading position of the conveying path and is provided above the reading position, the first conveying roller pair nipping and conveying the document passing through the conveying path;

a second conveying roller pair which is provided downstream in the sheet feed direction from the reading position of the conveying path and is provided above the reading position, the second conveying roller pair nipping and conveying the document passing through the conveying path at a document conveying speed faster than the first conveying roller pair;

a post-reading conveying path which is provided in the conveying path and is extended from a nipping position of the second conveying roller pair in a downstream direction having a slope relative to a horizontal plane, the slope being as large as a slope of a line which is tangent to the second conveying roller pair at the nipping position running in the reverse sheet feed direction relative to the horizontal plane; and a third conveying roller pair which is provided on the post-reading conveying path, the third conveying roller pair nipping and conveying the document conveyed from the second conveying roller pair at a conveying force equivalent to that of the second conveying roller pair, wherein an intersection portion of the conveying path with the post-reading conveying path is located in the reverse sheet feed direction from the nipping position of the second conveying roller pair, and wherein the post-reading conveying path is extended above the document supplying position.

12. The document feeder according to claim 11, wherein the third conveying roller pair is located in the reverse sheet feed direction from the intersecting portion.

13. The document feeder according to claim 11 further comprising:

a controller configured to drive the first, second and third conveying roller pairs and to control the conveying force applied by each of the first, second and third conveying roller pairs such that the document conveying speed of the second conveying roller pair is faster than the document conveying speed of the first conveying roller pair.

* * * * *